US008789861B2

(12) United States Patent
Takayanagi et al.

(10) Patent No.: US 8,789,861 B2
(45) Date of Patent: Jul. 29, 2014

(54) VEHICLE DOOR OPERATING MECHANISM

(75) Inventors: Shinsuke Takayanagi, Okazaki (JP); Toshio Machida, Toyota (JP); Keisuke Matsumoto, Anjo (JP); Yasutaka Shinoda, Anjo (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 509 days.

(21) Appl. No.: 13/109,292

(22) Filed: May 17, 2011

(65) Prior Publication Data

US 2012/0056437 A1 Mar. 8, 2012

(30) Foreign Application Priority Data

Sep. 3, 2010 (JP) ..... 2010-197552

(51) Int. Cl.
*E05C 19/10* (2006.01)

(52) U.S. Cl.
USPC ..... 292/218; 292/201; 292/216

(58) Field of Classification Search
USPC ..... 292/118, 201, 216, DIG. 23
See application file for complete search history.

(56) References Cited

U.S. PATENT DOCUMENTS

| | | | | |
|---|---|---|---|---|
| 6,779,372 | B2 * | 8/2004 | Arlt et al. | 70/237 |
| 8,215,683 | B2 * | 7/2012 | Drescher et al. | 292/216 |
| 8,333,414 | B2 * | 12/2012 | Takayanagi et al. | 292/201 |
| 2008/0105011 | A1 * | 5/2008 | Machida et al. | 70/237 |
| 2009/0267359 | A1 * | 10/2009 | Takayanagi et al. | 292/201 |
| 2010/0026014 | A1 * | 2/2010 | Machida et al. | 292/216 |

FOREIGN PATENT DOCUMENTS

JP 2010-31569 A 2/2010

* cited by examiner

*Primary Examiner* — Mark Williams
(74) *Attorney, Agent, or Firm* — Buchanan Ingersoll & Rooney PC

(57) ABSTRACT

A vehicle door operating mechanism includes a ratchet interlocking lever, a handle interlocking lever, a motor power transmitting lever, and a force relaying member movable between a normal unlocking position, at which a force is transmittable from the handle interlocking lever and the motor power transmitting lever to the ratchet interlocking lever, and a locking position, at which the force is not transmittable from the handle interlocking lever and the motor power transmitting lever to the ratchet interlocking lever, wherein an emergency unlocking position, at which the force is transmittable from the handle interlocking lever to the ratchet interlocking lever and the force is not transmittable from the motor power transmitting lever to the ratchet interlocking lever, is set within a moving range of the force relaying member, and the motor power transmitting lever includes a guide portion for retaining the force relaying member at the emergency unlocking position.

14 Claims, 27 Drawing Sheets

VEHICLE DOOR OPERATING MECHANISM

CROSS REFERENCE TO RELATED APPLICATIONS

This application is based on and claims priority under 35 U.S.C. §119 to Japanese Patent Application 2010-197552, filed on Sep. 3, 2010, the entire content of which is incorporated herein by reference.

TECHNICAL FIELD

This disclosure generally relates to a vehicle door operating mechanism, which is configured so as to unlock a retention of a vehicle door in a closed state by means of a latch/ratchet mechanism by using a power generated by a motor.

BACKGROUND DISCUSSION

Generally, a vehicle door operating mechanism is configured so that a vehicle door is not retained to be in a closed state by a latch/ratchet mechanism (i.e. the vehicle door becomes unlatchable) once again in a case where a malfunction and the like occurs at a motor while the vehicle door is unlatched. Disclosed in JP2010-31569A is an example of a known vehicle door operating mechanism that is configured so as to include a motor disconnecting operation portion inside a vehicle door so that a latch/ratchet mechanism is operable even in the above-mentioned emergency state. More specifically, the vehicle door operating mechanism disclosed in JP2010-31569A is configured so as to allow a tool to be inserted into an operation hole formed at the vehicle door so as to penetrate therethrough in order to operate the motor disconnecting operation portion, thereby disconnecting the motor from the latch/ratchet mechanism in the above-mentioned emergency state. As a result, the vehicle door operating mechanism is restored to a state where the vehicle door is allowed to be latched.

However, a user may contact a repair engineer or check a vehicle manual book in the emergency because the user does not know of an existence of the motor disconnecting operation portion and of the operation hole, so that the user may not promptly restore the vehicle door operating mechanism to be in the state where the vehicle door is allowed to be latched. Furthermore, even if the user knows of the existence of the motor disconnecting operation portion and of the operation hole, the user needs to operate the motor disconnecting operation portion through the operation hole, so that the user may not promptly restore the vehicle door operating mechanism to be in the state where the vehicle door is allowed to be latched.

A need thus exists to provide a vehicle door operating mechanism which is not susceptible to the drawback mentioned above.

SUMMARY

According to an aspect of this disclosure, a vehicle door operating mechanism includes a ratchet interlocking lever configured so as to be interlinked with a ratchet of a latch/ratchet mechanism for retaining a vehicle door of a vehicle in a closed state and so as to be rotated in a first rotational direction from an initial position in a case where a retention of the vehicle door in the closed state by the latch/ratchet mechanism is released, a handle interlocking lever configured so as to be interlinked with the ratchet interlocking lever, rotated in the first rotational direction from an initial position while receiving an operating force generated in response to an opening operation of an operating handle, and so as to apply a force in the first rotational direction to the ratchet interlocking lever, a motor power transmitting lever configured so as to be interlinked with the ratchet interlocking lever, rotated in the first rotational direction from an initial position while receiving a force generated by a release motor, and so as to apply the force in the first rotational direction to the ratchet interlocking lever, and a force relaying member provided between the ratchet interlocking lever and the handle interlocking lever on the one hand and the motor power transmitting lever on the other hand, and configured so as to be movable between a normal unlocking position, at which the force is transmittable from the handle interlocking lever and the motor power transmitting lever to the ratchet interlocking lever in response to a locking/unlocking operation of a lock operating portion that is used for locking and unlocking the vehicle door, and a locking position, at which the force is not transmittable from the handle interlocking lever and the motor power transmitting lever to the ratchet interlocking lever, wherein an emergency unlocking position, at which the force is transmittable from the handle interlocking lever to the ratchet interlocking lever and the force is not transmittable from the motor power transmitting lever to the ratchet interlocking lever, is set within a moving range of the force relaying member, and the motor power transmitting lever includes a guide portion, which is configured so as to retain the force relaying member at the emergency unlocking position, so as to be located to correspond to a portion of an entire rotation range of the motor power transmitting lever in the first rotational direction except for the initial position.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

First Embodiment

Figure 1:
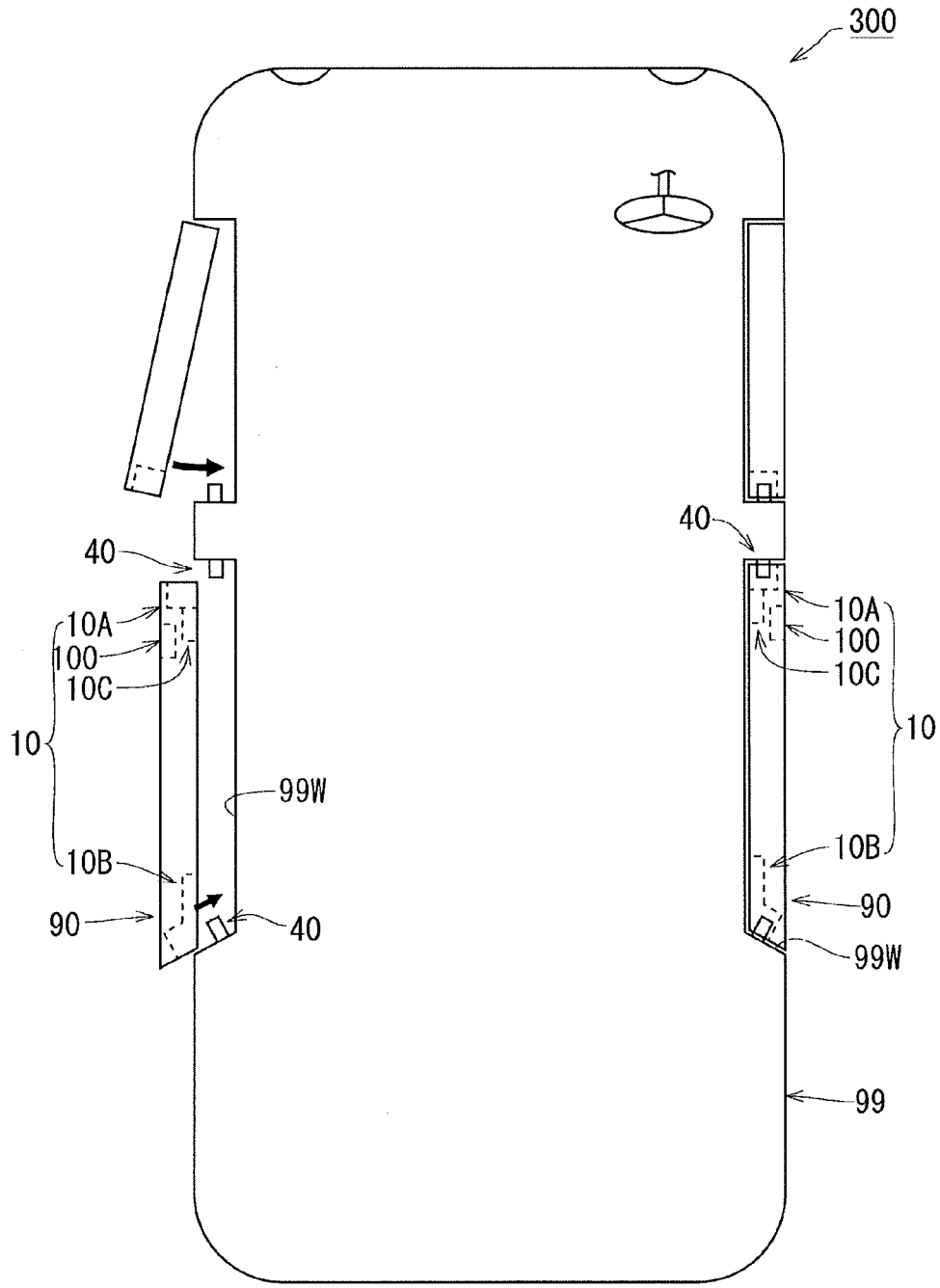
FIG. 1 is a diagram schematically illustrating a vehicle having a vehicle door operating mechanism according to a first embodiment.

A first embodiment of a vehicle door operating mechanism 100K will be described below with reference to FIGS. 1 to 17 of the attached drawings. Illustrated in FIG. 1 is a vehicle 300 having a slide door 90 (an example of a vehicle door). The slide door 90 is configured so as to be moved in a diagonally backward direction from a state where the slide door 90 closes an opening, which is formed at a vehicle body 99 to allow a passenger to enter into and exit from the vehicle 300, then, the slide door 90 is moved backward along the vehicle body 99 before the slide door 90 is completely moved to a most backward position until the slide door 90 fully opens the opening. An outer door handle 17 (see FIG. 5) (i.e. an operating handle) is provided at a surface of the slide door 90 facing outside of the vehicle 300 and an inner door handle 18 (see FIG. 2) (i.e. the operating handle) is provided at a surface of the slide door 90 facing an interior of the vehicle in order to allow a user to operate the slide door 90 to open and close the opening formed at the vehicle body 99. The outer door handle 17 is configured as, for example, a grip-type handle, which is operated in a manner where the user pulls the handle towards the user. Furthermore, an interior lock operating portion 16 (see FIG. 2), which serves as a lock operating portion, is provided at the surface of the slide door 90 facing the interior of the vehicle 300 in order to lock the slide door 90 so as not to be opened even in a case where the outer door handle 17 and the inner door handle 18 are operated to open the slide door 90. The inner door handle 18 and the interior lock operating portion 16 will be described later in more detail.

Figure 2:
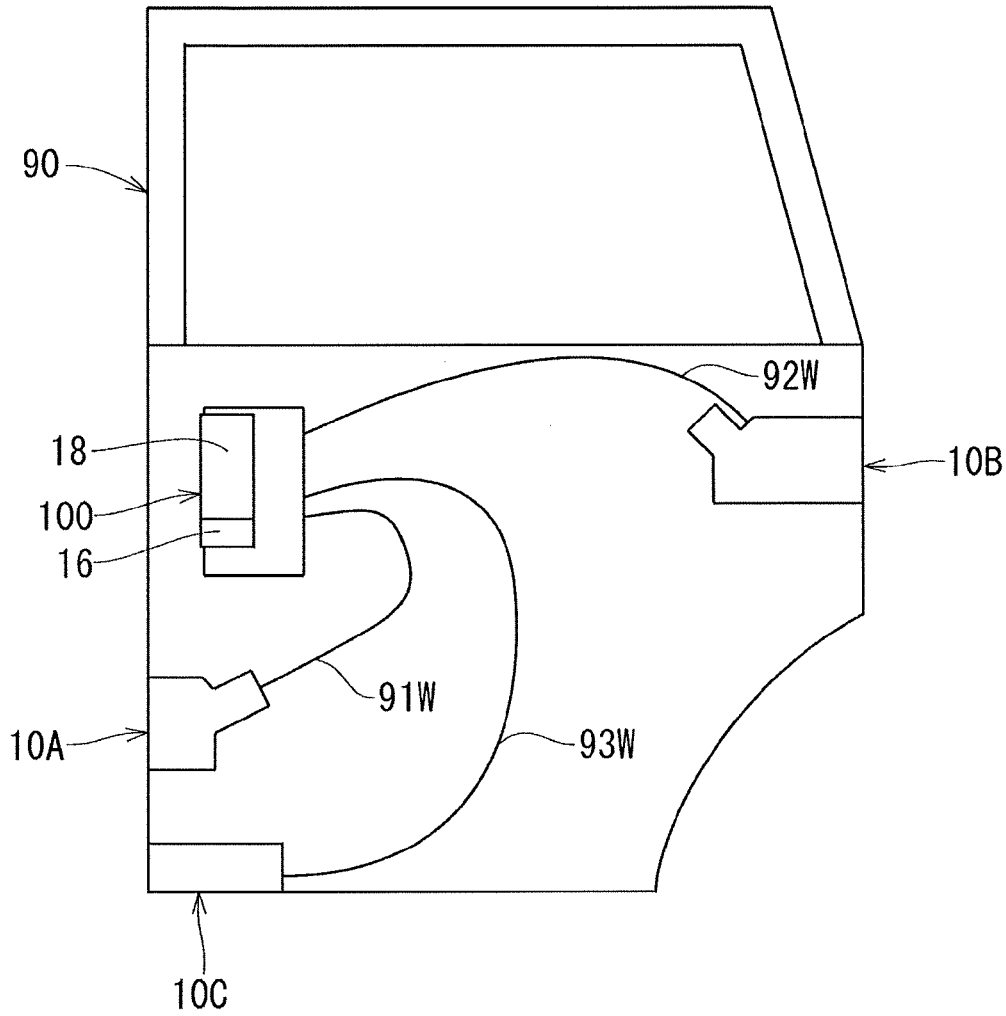
FIG. 2 is a diagram schematically illustrating a slide door having a door lock apparatus.

As illustrated in FIG. 2, a door lock apparatus 10 includes a front lock mechanism 10A and a rear lock mechanism 10B for retaining the slide door 90 in a closed state, a fully-open door lock mechanism 10C for retaining the slide door 90 in a fully-opened state, and a remote control receiving device 100, which is connected to the front lock mechanism 10A, the rear lock mechanism 10B and the fully-open door lock mechanism 10C so as to be provided at an inside of the slide door 90.

Each of the front lock mechanism 10A, the rear lock mechanism 10B and the fully-open door lock mechanism 100 is provided at a predetermined different portion of the slide door 90. A striker 40 is provided at three different portions of an inner surface of a door frame 99W (a frame of the opening) so as to correspond to each of the front lock mechanism 10A, the rear lock mechanism 10B and the fully-open door lock mechanism 10C. In FIG. 1, only two strikers 40 are illustrated.

Figure 3:
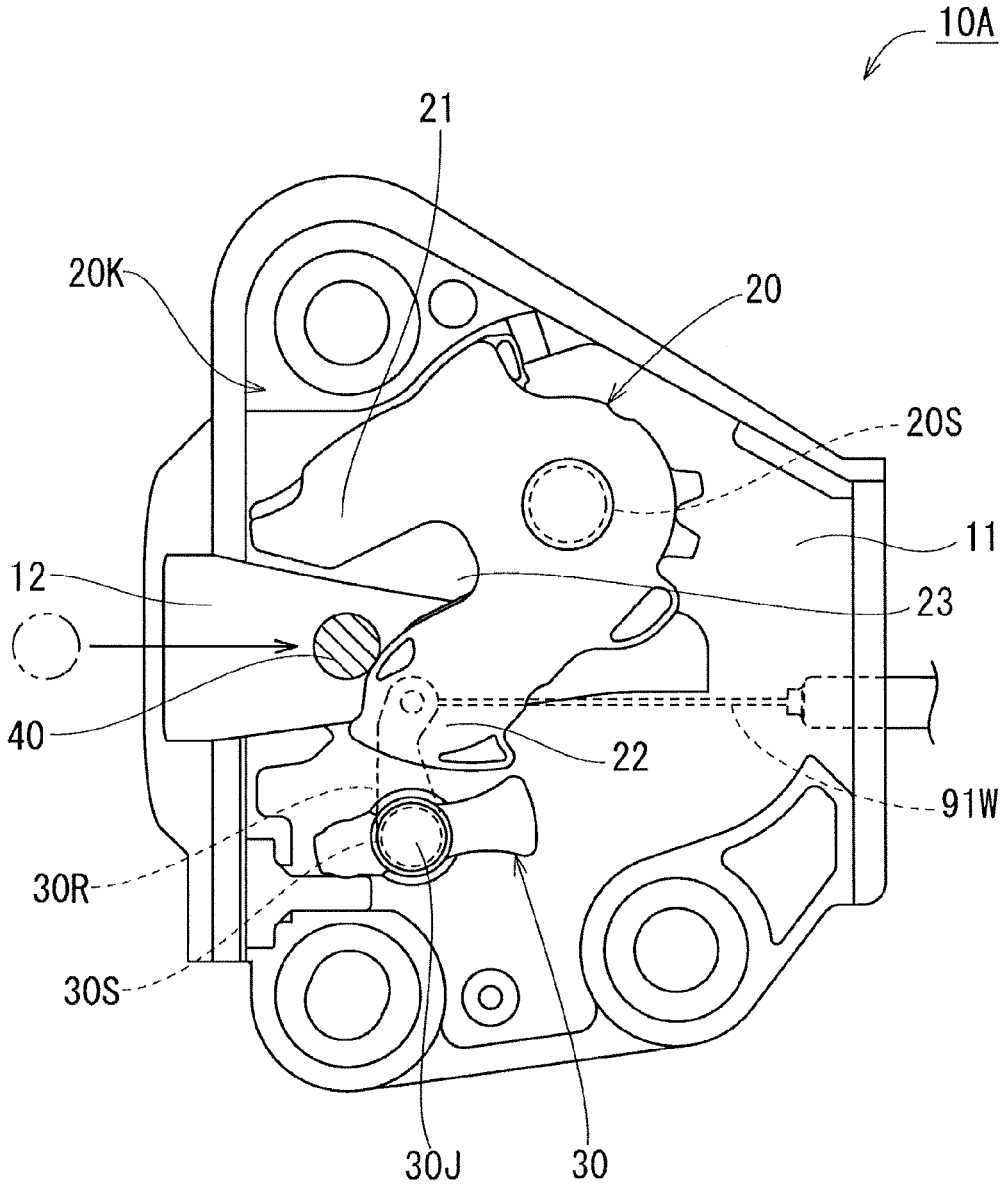
FIG. 3 is a side view of a latch/ratchet mechanism in a state where a latch and a striker are not engaged with each other.

As illustrated in FIG. 3, the front lock mechanism 10A is configured so as to include a latch/ratchet mechanism 20K having a latch 20, a ratchet 30, a striker receiving groove 12 and the like on a base plate 11.

The striker receiving groove 12 is formed so as to extend in a horizontal direction (a front-rear direction of the vehicle 300). An end portion of the striker receiving groove 12 is opened to the vehicle interior. On the other hand, the other end portion of the striker receiving groove 12 is closed. In a process of closing the slide door 90, the striker 40 is entered into the striker receiving groove 12 from the one end portion thereof.

The ratchet 30 is rotatably supported by means of a rotary shaft 30J at a portion of the base plate 11 lower than the striker receiving groove 12. Accordingly, the ratchet 30 is formed so as to protrude from the rotary shaft 30J towards the latch 20. A torsion coil spring 30S is provided between the ratchet 30 and the base plate 11, so that the ratchet 30 is biased in a counterclockwise direction in FIG. 3 by means of the torsion coil spring 30S. Furthermore, the ratchet 30 integrally includes a ratchet actuating lever 30R behind the base plate 11 (i.e. on a surface of the base plate 11 opposite to a surface thereof on which the ratchet 30 and the like are provided). The ratchet actuating lever 30R is connected to the remote control receiving device 100 via a first open cable 91W. The first open cable 91W is normally pulled towards the ratchet 30 by means of the torsion coil spring 30S. In a case where the first open cable 91W is pulled towards the remote control receiving device 100 so as to resist against a biasing force generated by the torsion coil spring 30S, the ratchet 30 is rotated in a clockwise direction in FIG. 3.

The latch 20 is rotatably supported by a shaft at a portion of the base plate 11 above the striker receiving groove 12. The latch 20 includes a first engagement pawl 21 and a second engagement pawl 22. More specifically, the first engagement pawl 21 and the second engagement pawl 22 are formed at the latch 20 so as to extend in the same direction while forming a space therebetween, which serves as a striker receiving portion 23. The latch 20 is biased in an unlatching direction (i.e.

in the clockwise direction in FIG. 3) by means of a torsion coil spring 20S, which is provided between the latch 20 and the base plate 11. Furthermore, in a case where the slide door 90 is opened (partially opened or fully-opened), the latch 20 is positioned at an end position in the unlatching direction as illustrated in FIG. 3.

In a case where the slide door 90 is slid in a closing direction (i.e. in a direction of closing the slide door 90) while the state in FIG. 3 is established, the striker 40 entered into the striker receiving groove 12 is received at the striker receiving portion 23, and the striker 40 presses the second engagement pawl 22, which is positioned rearwardly of the first engagement pawl 21 in the front-rear direction of the vehicle, so as to rotate the latch 20 in a latching direction, which is opposite to the unlatching direction and which corresponds to the counterclockwise direction in FIG. 3. Accordingly, the latch 20 and the striker 40 engage with each other as illustrated in FIG. 4.

Figure 4:
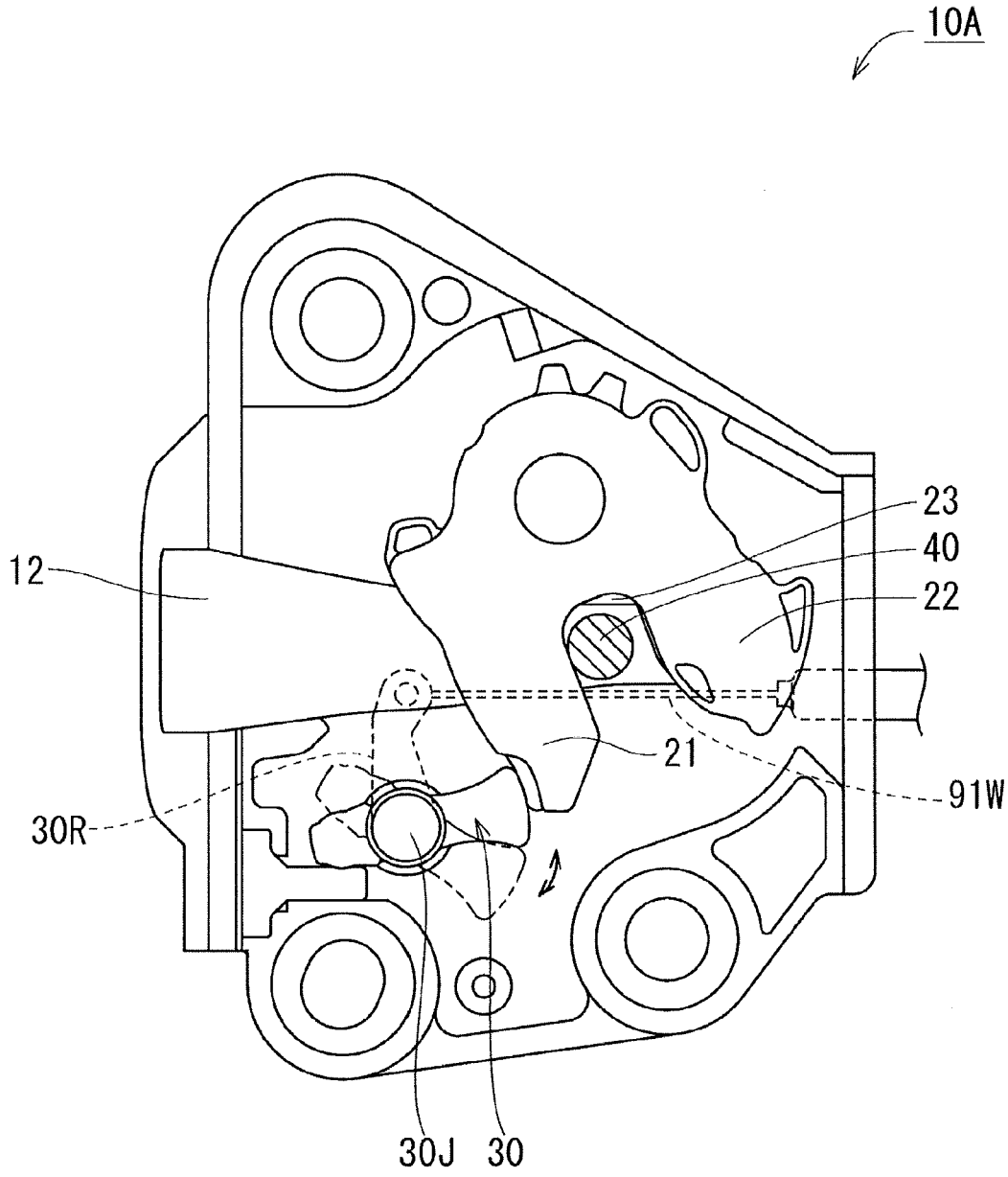
FIG. 4 is a side view of the latch/ratchet mechanism in a state where the latch and the striker are engaged with each other.

While the engagement between the latch 20 and the striker 40 as illustrated in FIG. 4 is established, the ratchet 30 contacts the first engagement pawl 21, which is positioned in front of the second engagement pawl 22, so that the latch 20 is not allowed to rotate in the unlatching direction (i.e. in a clockwise direction in FIG. 4). In other words, the ratchet 30 maintains the state where the latch 20 and the striker 40 engage with each other.

Furthermore, in a case where the outer door handle 17 or the inner door handle 18 is operated to open the slide door 90 while the latch 20 and the striker 40 engage with each other (i.e. while the slide door 90 is retained in the closed state), the first open cable 91W is pulled towards the remote control receiving device 100. Accordingly, as illustrated by a chain double-dashed line in FIG. 4, the ratchet 30 is rotated in the clockwise direction in FIG. 4 so as to retract to an outside of a rotation range of the latch 20. As a result, a rotation restriction on the latch 20 by means of the ratchet 30 is lifted, so that the latch 20 is allowed to rotate in the unlatching direction.

Described above is an explanation about the front lock mechanism 10A. As is the case with the front lock mechanism 10A, the rear lock mechanism 10B also includes a latch/ratchet mechanism configured so as to be actuated in the same manner as the latch/ratchet mechanism 20K of the front lock mechanism 10A. A ratchet of the rear lock mechanism 10B is connected to the remote control receiving device 100 by means of a second open cable 92W (see FIG. 2). In the case where the outer door handle 17 or the inner door handle 18 is operated so as to open the slide door 90, the second open cable 92W is pulled towards the remote control receiving device 100, so that a rotation restriction on a latch of the rear lock mechanism 10B by means of the ratchet is lifted.

In a case where the latches 20 and the strikers 40 are retained to engage with each other in the latch/ratchet mechanisms 20K of the front lock mechanism 10A and the rear lock mechanism 10B, respectively (i.e. in the case where the state illustrated in FIG. 4 is retained), the slide door 90 is retained in the closed state. On the other hand, in the case where the rotation restriction on the latches 20 by the ratchets 30 of the front lock mechanism 10A and the rear lock mechanism 10B, respectively, is lifted, the retention of the slide door 90 in the closed state is lifted (i.e. the slide door 90 is unlatched), so that the slide door 90 is allowed to be opened (i.e. the slide door 90 is allowed to be slid in the opening direction). Additionally, the vehicle 300 includes an electric door opening/closing mechanism (i.e. a power slide door mechanism), which is configured so as to electrically open and close the slide door 90. More specifically, the electric door opening/closing mechanism is actuated in conjunction with the unlatching operation by means of the front lock mechanism 10A and the rear lock mechanism 10B in order to electrically open the slide door 90.

As is the case with the front lock mechanism 10A, the fully-open door lock mechanism 100 also includes a latch/ratchet mechanism. The latch/ratchet mechanism of the fully-open door lock mechanism 10C is configured so that a latch and a striker thereof engage with each other in the case where the slide door 90 is fully opened and a ratchet contacts the latch in order to restrict a rotation of the latch in the unlatching direction. The ratchet of the fully-open door lock mechanism 100 is connected to the remote control receiving device 100 by means of a third open cable 93W (see FIG. 2).

In a case where the outer door handle 17 or the inner door handle 18 is operated to close the slide door 90 while the slide door 90 is in a fully-opened state, the third open cable 93W is pulled towards the remote control receiving device 100. Accordingly, a rotation restriction on the latch by means of the ratchet is lifted, so that the slide door 90 in the fully-opened state is allowed to be closed (i.e. the slide door 90 is allowed to be slid in the closing direction). Additionally, in a case where latching of the slide door 90 by the fully-open door lock mechanism 100 is released, the electric door opening/closing mechanism is actuated, so that the slide door 90 is electrically closed.

Figure 5:
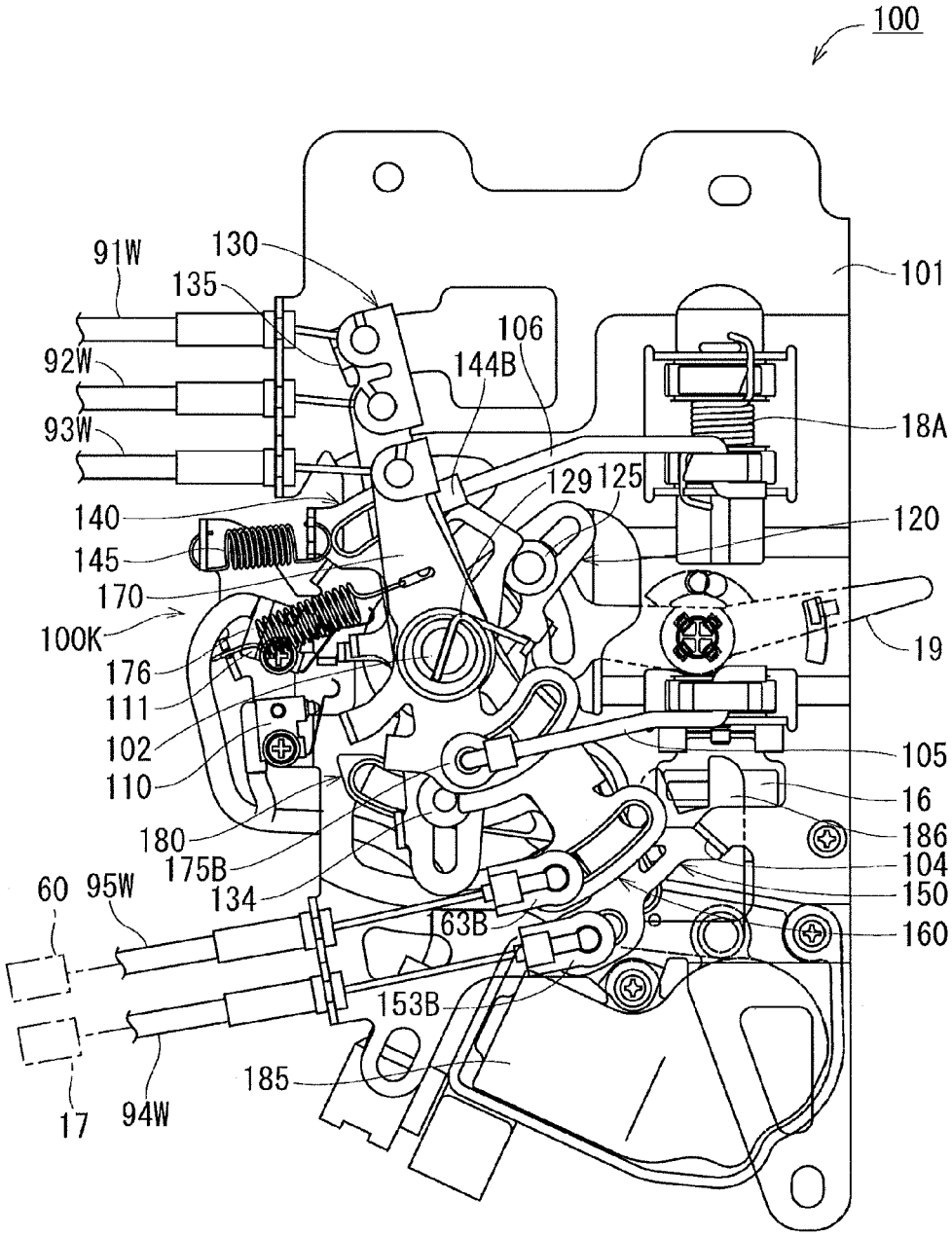
FIG. 5 is a front view of the remote control receiving device.

As illustrated in FIG. 2, the remote control receiving device 100 is arranged at a front end portion of the slide door 90. As illustrated in FIG. 5, the remote control receiving device 100 is configured so as to include the vehicle door operating mechanism 100K on a plate 101.

Figure 6:
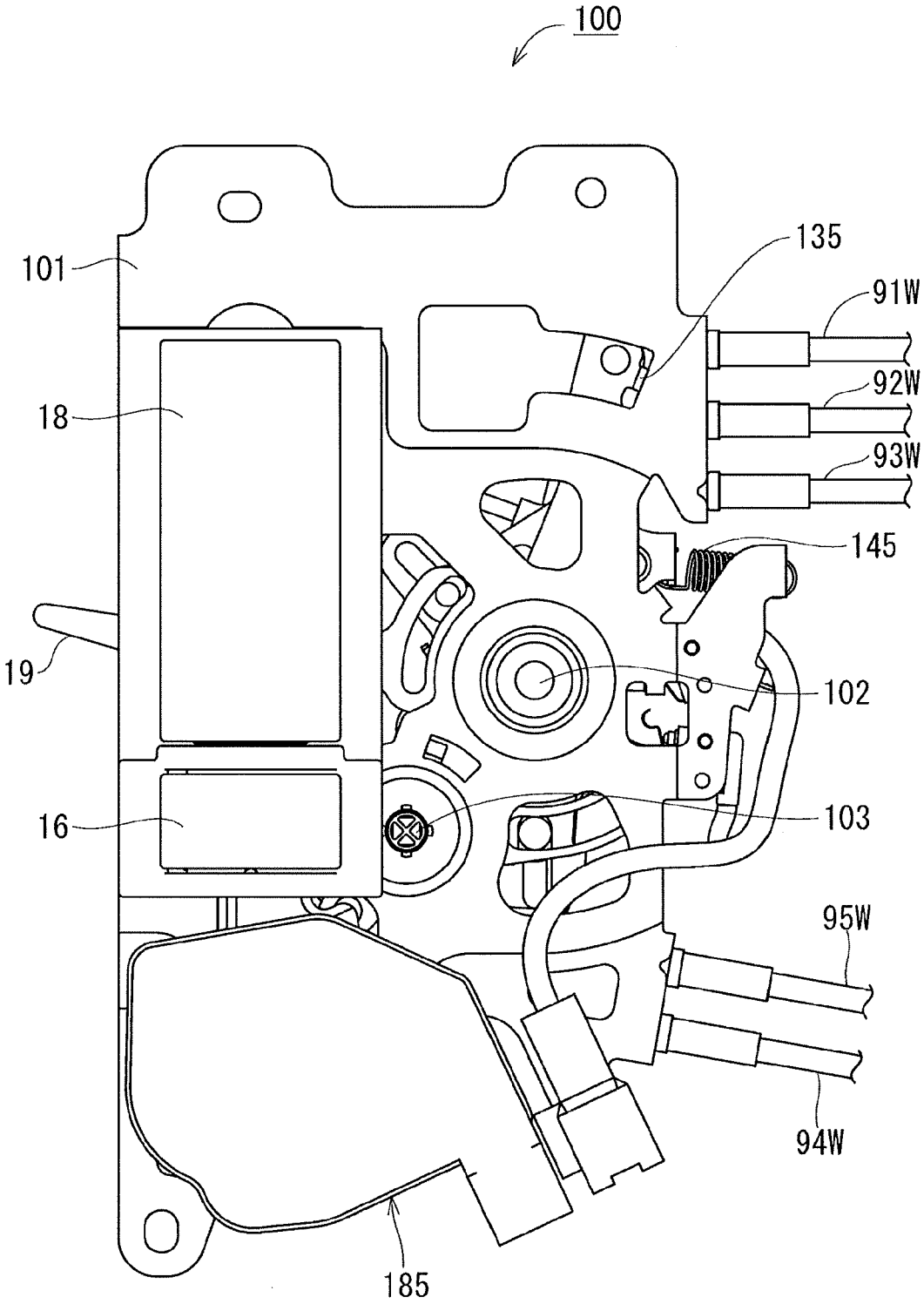
FIG. 6 is a back view of the remote control receiving device.

As illustrated in FIG. 6, the inner door handle 18 and the interior lock operating portion 16 are provided at a surface of the plate 101 differing from a surface thereof on which the vehicle door operating mechanism 100K is provided. The plate 101 is fixed on a door panel of the slide door 90 positioned closer to the vehicle interior in a state where the surface of the plate 101, at which the inner door handle 18 and the interior lock operating portion 16 are provided, faces an inner surface of the door panel facing the vehicle interior.

The inner door handle 18 is formed to have an elongated shape so as to extend in an up-and-down direction of the vehicle 300. The inner door handle 18 is exposed to the vehicle interior on the surface of the slide door 90 facing the vehicle interior. Furthermore, the inner door handle 18 is configured so as to be tiltable in a sliding direction of the slide door 90. More specifically, the inner door handle 18 is biased by means of a torsion coil spring 18A (see FIG. 5) so as to be positioned at an initial position illustrated in FIG. 6. The inner door handle 18 is configured so as to perform a closing operation for tilting the inner door handle 18 in the closing direction of the slide door 90 (to the left in FIG. 6) from the initial position and an opening operation for tilting the inner door handle 18 in the opening direction of the slide door 90 (to the right in FIG. 6) from the initial position.

The interior lock operating portion 16 is arranged below the inner door handle 18. The interior lock operating portion 16 is exposed to the vehicle interior on the surface of the slide door 90 facing the vehicle interior. Furthermore, the interior lock operating portion 16 is configured so as to be movably operated in the sliding direction of the slide door 90. More specifically, in a case where the interior lock operating portion 16 is movably operated in the opening direction of the slide door 90 from a position illustrated in FIG. 6, the slide door 90 is turned to be in an unlocked state where the slide door 90 is allowed to be opened in response to an opening operation of the inner door handle 18 or the outer door handle 17. On the other hand, in the case where the interior lock operating portion 16 is movably operated in the closing direction of the slide door 90 so as to be positioned as illustrated in FIG. 6, the slide door 90 is turned to be in a locked state where the slide door 90 is not opened even if the opening operation of the inner door handle 18 or the outer door handle 17 is performed. Hereinafter, the movable operation of the interior lock operating portion 16 in the closing direction of the slide door 90 is referred to as a locking operation. On the other hand, the movable operation of the interior lock operating portion 16 in the opening direction of the slide door 90 is referred to as an unlocking operation.

Figure 7:
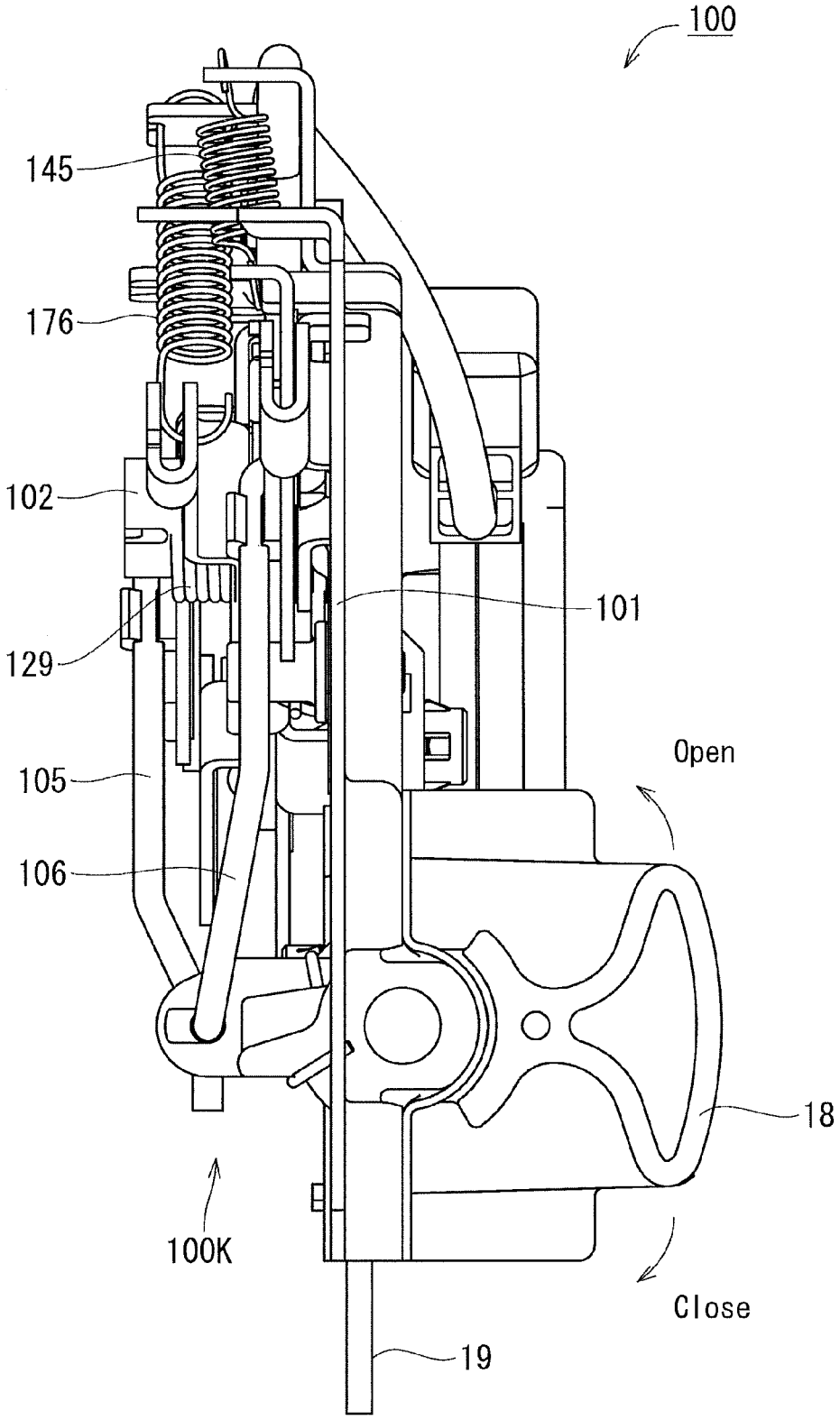
FIG. 7 is a side view of the remote control receiving device.

As illustrated in FIG. 7, the vehicle door operating mechanism 100K is provided on the surface of the plate 101 differing from the surface thereof where the interior lock operating portion 16 and the inner door handle 18 are provided. Furthermore, the entire vehicle door operating mechanism 100K is provided at the inside of the slide door 90. As illustrated in FIG. 5, the vehicle door operating mechanism 100K is configured so that a connecting pin penetrating lever 120, a ratchet interlocking lever 130, an inner handle connecting lever 140, an outer handle connecting lever 150, a motor power transmitting lever 160, and a fully-open lock lever 170 are piled on the plate 101 in the above-mentioned order and are rotatably supported by a main support shaft 102, which is formed on the plate 101 so as to protrude therefrom. Furthermore, the vehicle door operating mechanism 100K includes a locking lever 180, which is rotatably supported by a sub-support shaft 103 (see FIG. 6) formed on the plate 101 so as to protrude therefrom. Additionally, the locking lever 180 is made of a resin. On the other hand, each of the connecting pin penetrating lever 120, the ratchet interlocking lever 130, the inner handle connecting lever 140, the outer handle connecting lever 150, the motor power transmitting lever 160 and the fully-open lock lever 170 is made of a metal. The vehicle door operating mechanism 100K will be described in more detail below.

Figure 8:
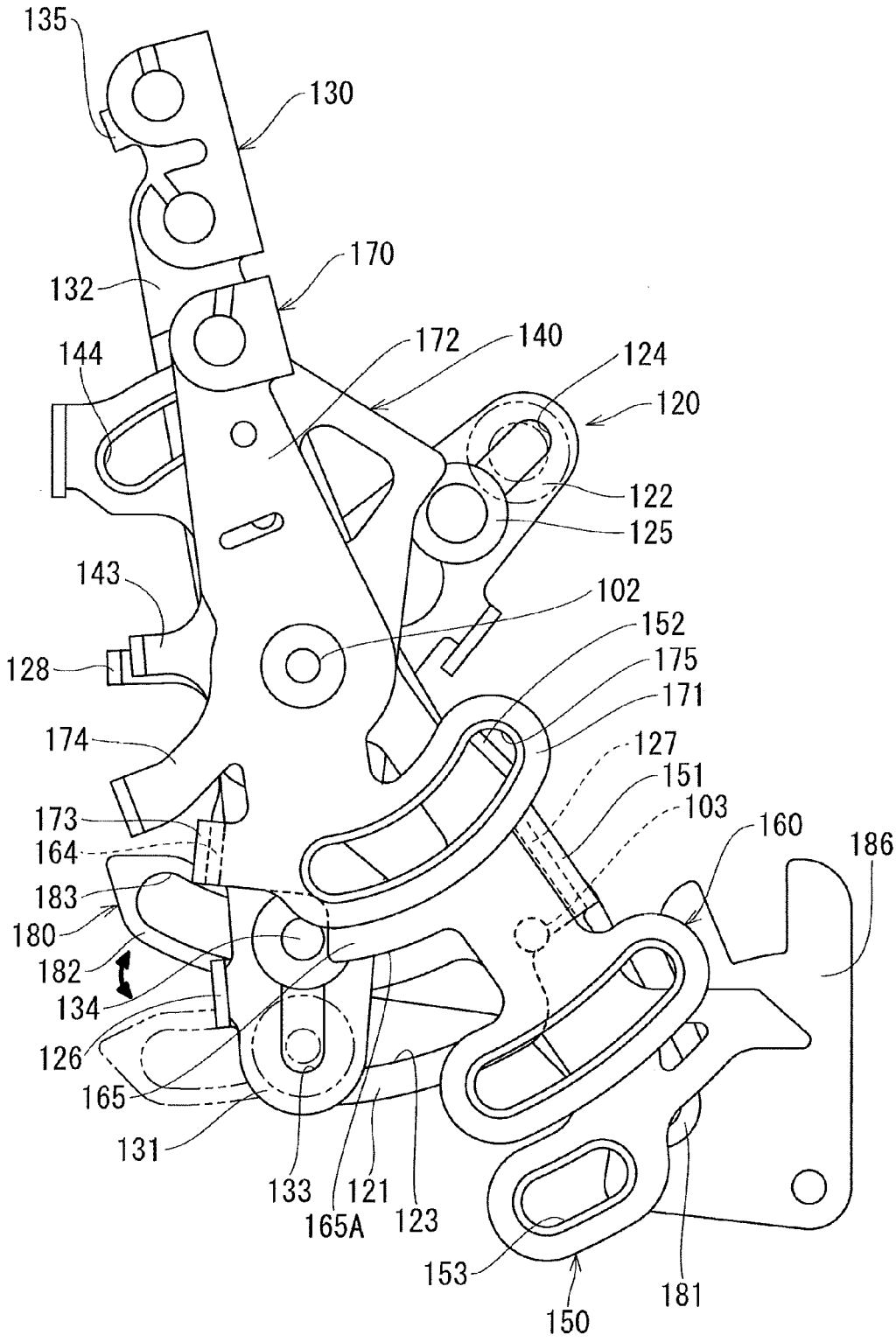
FIG. 8 is a front view of the vehicle door operating mechanism in a normal operation state.

Illustrated in FIG. 8 are main components of the vehicle door operating mechanism 100K. As illustrated in FIG. 8, the fully-open lock lever 170 includes a first lever piece 171 and a second lever piece 172, which extend in an opposite direction from each other relative to the main support shaft 102. The ratchet of the fully-open door lock mechanism 10C is connected to the second lever piece 172 via the third open cable 93W (see FIG. 5). An elongated hole 175, which has an arc shape centering on the main support shaft 102, is formed at the first lever piece 171 so as to penetrate therethrough. A slide bush 175B, to which an end portion of a first rod 105 extending from the inner door handle 18 is fixed, is slidably supported within the elongated hole 175 (see FIG. 5). In the case where the inner door handle 18 is operated to close the slide door 90 (i.e. in the case where the inner door handle 18 is tilted to the left in FIG. 6), the fully-open lock lever 170 is pushed by the first rod 105 so as to be rotated about the main support shaft 102 in a first rotational direction (which corresponds to the clockwise direction in FIG. 5 and FIG. 8). Accordingly, the third open cable 93W, which is connected to the second lever piece 172, is pulled towards the remote control receiving device 100, so that the rotation restriction on the latch by the ratchet of the fully-open door lock mechanism 10C is lifted. Additionally, in the case where the inner door handle 18 is operated to open the slide door 90, the first rod 105 is pulled towards the inner door handle 18. However, because a displacement of the slide bush 175B is limited within the elongated hole 175, the fully-open lock lever 170 is retained at an initial position illustrated in FIG. 7. The fully-open lock lever 170 is biased in a second rotational direction, which is opposite to the first rotational direction, by means of a coil spring 176, which connects the plate 101 and the second lever piece 172 (see FIG. 5). Furthermore, a switch pressing piece 174 is integrally formed at the fully-open lock lever 170. The switch pressing piece 174 is formed so as to protrude from the fully-open lock lever 170 towards a first switch 110, which is fixed on the plate 101 (see FIG. 5). Accordingly, the switch pressing piece 174 is configured so as to press (turn on) the first switch 110 in response to the rotation of the fully-open lock lever 170 in the first rotational direction.

Figure 13:
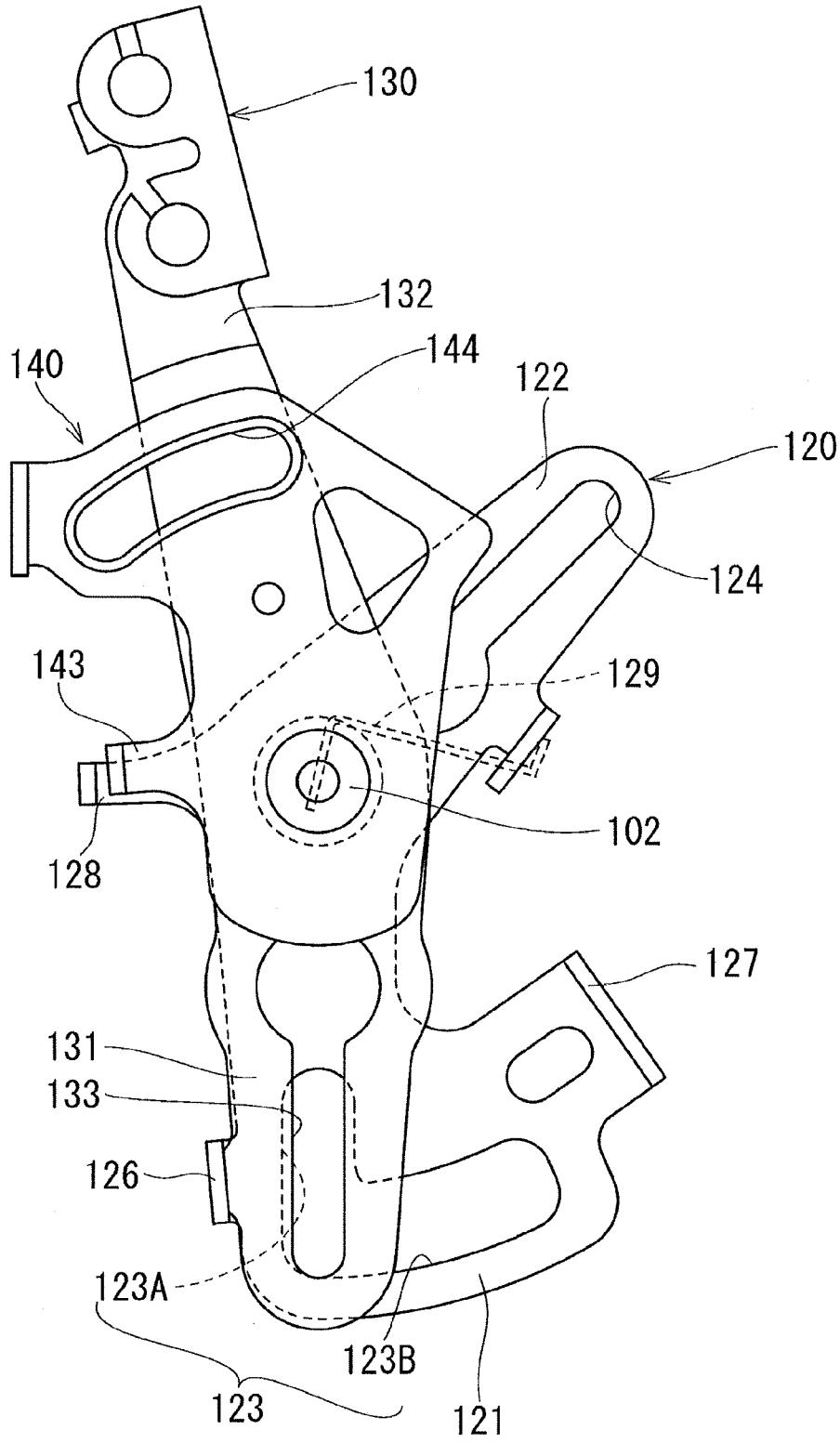
FIG. 13 is a front view of an inner handle connecting lever, a connecting pin penetrating lever and a ratchet interlocking lever.

The inner handle connecting lever 140 is placed on the second lever piece 172 of the fully-open lock lever 170. As illustrated in FIG. 13, an elongated hole 144, which is formed so as to have an arc shape centering on the main support shaft 102, is formed at an end portion of the inner handle connecting lever 140 located away from the main support shaft 102 so as to penetrate through the end portion. A slide bush 144B, to which an end portion of a second rod 106 extending from the inner door handle 18 is fixed, is slidably supported within the elongated hole 144 (see FIG. 5). Furthermore, the inner handle connecting lever 140 is biased in the second rotational direction, which is opposite to the first rotational direction, by a coil spring 145, which connects the inner handle connecting lever 140 and the plate 101 (see FIG. 5). In the case where the inner door handle 18 is operated to open the slide door 90 (i.e. in the case where the inner door handle 18 is tilted to the right in FIG. 6), the second rod 106 is pulled to the inner door handle 18. Accordingly, the inner handle connecting lever 140 is rotated about the main support shaft 102 in the first rotational direction (i.e. in the clockwise direction in FIG. 5 and FIG. 8) (the state of the inner handle connecting lever 140 when being rotated is shifted from the state illustrated in FIG. 8 to the state illustrated in FIG. 9). Additionally, in the case where the inner door handle 18 is operated to close the slide door 90, the second rod 106 is pushed towards the inner handle connecting lever 140. However, because a displacement of the slide bush 142B is limited within the elongated hole 142, the inner handle connecting lever 140 is retained at an initial position illustrated in FIG. 8.

A switch pressing piece 143 is integrally formed at the inner handle connecting lever 140. The switch pressing piece 143 is formed so as to protrude from the inner handle connecting lever 140 towards a second switch 111, which is fixed on the plate 101 (see FIG. 5). Accordingly, the switch pressing piece 143 is configured so as to press (turn on) the second switch 111 in response to the rotation of the inner handle connecting lever 140 in the first rotational direction.

As illustrated in FIG. 13, the connecting pin penetrating lever 120 includes a first lever piece 121 and a second lever piece 122, which are formed so as to protrude to one side (in the same direction) relative to the main support shaft 102. The main support shaft 102 and the second lever piece 122 are connected to each other by means of a torsion coil spring 129, so that the connecting pin penetrating lever 120 is biased by the torsion coil spring 129 in the second rotational direction, which is opposite to the first rotational direction. The first lever piece 121 is placed on the ratchet interlocking lever 130. Furthermore, the first lever piece 121 is formed to protrude relative to the main support shaft 102 in a rotating radial direction and so that an end portion of the first lever piece 121 is curved in the second rotational direction so as to from an L-shape. An L-shaped hole 123 is formed at the first lever piece 121 along the L-shape thereof so as to penetrate therethrough. The L-shaped hole 123 includes a first side passage 123A extending in the rotating radial direction and a second side passage 123B, which extends in the second rotational direction from an end portion of the first side passage 123A positioned away from the main support shaft 102. A connecting pin 134 (see FIG. 5) is inserted within the L-shaped hole 123 so as to penetrate the first lever piece 121.

The second lever piece 122 of the connecting pin penetrating lever 120 is arranged at a position in front of the inner handle connecting lever 140 in the first rotational direction. Furthermore, a child lock elongated hole 124 is formed at the second lever piece 122 so as to extend in the rotating radial direction and so as to penetrate through the second lever piece 122. A child lock pin 125 is supported within the child lock elongated hole 124 (see FIG. 5). The child lock pin 125 penetrates through the second lever piece 122 at the child lock elongated hole 124 while allowing the child lock pin 125 to reciprocate along a pair of side portions defining the child lock elongated hole 124 in a longitudinal direction thereof. Additionally, the child lock elongated hole 124 and the child lock pin 125 serve as a child lock switching mechanism.

A child lock operating portion 19 (see FIG. 5) is provided at the remote control receiving device 100 in order to operate the child lock pin 125 to be displaced from an outside of the slide door 90. The child lock operating portion 19 is rotatably supported at the plate 101. One end portion of the child lock operating portion 19 positioned away from a rotation center thereof is exposed from an end surface of the slide door 90. The other end portion of the child lock operating portion 19 positioned away from the rotation center in the opposite direction to the one end portion of the child lock operating portion is connected to the child lock pin 125. The child lock pin 125 is displaced between a child lock position located away from the main support shaft 102 (i.e. a position indicated by a chain double-dashed line in FIG. 8) and a child lock unlocking position located closer to the main support shaft 102 (i.e. a position indicated by a solid line in FIG. 8) in response to a rotational operation of the child lock operating portion 19. In a case where the child lock pin 125 is located at the child lock unlocking position, the child lock pin 125 is positioned within a rotation range of the inner handle connecting lever 140. Accordingly, the inner handle connecting lever 140 and the connecting pin penetrating lever 120 are connected by the child lock pin 125 so as to be integrally rotated as a unit in the first rotational direction. In other words, an operating force generated in response to the opening operation of the inner door handle 18 is transmittable to the connecting pin penetrating lever 120 from the inner handle connecting lever 140. On the other hand, in a case where the child lock pin 125 is located at the child lock position, the child lock pin 125 is positioned outside of the rotation range of the inner handle connecting lever 140. Therefore, the inner handle connecting lever 140 and the connecting pin penetrating lever 120 are disconnected from each other so as not to be interlinked with each other. In other words, the operating force generated in response to the opening operation of the inner door handle 18 is not transmittable to the connecting pin penetrating lever 120 from the inner handle connecting lever 140.

A switch pressing piece 128 is integrally formed at the connecting pin penetrating lever 120. The switch pressing piece 128 is formed so as to protrude from the connecting pin penetrating lever 120 towards the second switch 111, which is fixed on the plate 101 (see FIG. 5). Accordingly, the switch pressing piece 128 is configured so as to press (turn on) the second switch 111 in response to the rotation of the connecting pin penetrating lever 120 in the first rotational direction.

As illustrated in FIG. 13, the ratchet interlocking lever 130 includes a first lever piece 131 and a second lever piece 132, which extend in an opposite direction from each other relative to the main support shaft 102. The ratchet 30 of each of the front lock mechanism 10A and the rear lock mechanism 10B is connected to an end portion of the second lever piece 132, which protrudes in the same direction as the inner handle connecting lever 140 protrudes, via each of the first open cable 91W and the second open cable 92W (see FIG. 5).

An I-shaped elongated hole 133, which extends in the rotating radial direction and which corresponds to a member linearly moving passage, is formed at the first lever piece 131, which is placed on the first lever piece 121 of the connecting pin penetrating lever 120. The I-shaped elongated hole 133 is formed at the first lever piece 131 so as to be overlapped with the first side passage 123A of the connecting pin penetrating lever 120 so that the single connecting pin 134 penetrates the first lever piece 121 and the first lever piece 131 via the respective L-shaped hole 123 and the I-shaped elongated hole 133 in the case where the ratchet interlocking lever 130 and the connecting pin penetrating lever 120 are both located at the respective initial positions. The connecting pin 134 is reciprocable within the I-shaped elongated hole 133 while being guided by a pair of side portions defining the I-shaped elongated hole 133 extending in a longitudinal direction thereof. Additionally, the connecting pin 134 serves as a force relaying member.

The first lever piece 121 of the connecting pin penetrating lever 120 includes an interlocking contact piece 126, which is formed by bending a portion of an edge portion of the first lever piece 121 facing in the first rotational direction so as to orthogonally protrude therefrom towards the ratchet interlocking lever 130. The interlocking contact piece 126 is contactable with a portion of an edge portion of the first lever piece 131 of the ratchet interlocking lever 130 facing in the first rotational direction. Accordingly, the ratchet interlocking lever 130 receives the biasing force generated by the torsion coil spring 129 via the connecting pin penetrating lever 120 so as to be biased in the second rotational direction. Furthermore, a stopper portion 135, which is provided at an end portion of the second lever piece 132, normally contacts the plate 101 (see FIG. 5 and FIG. 6), so that the ratchet interlocking lever 130 and the connecting pin penetrating lever 120 are both located at the respective initial positions illustrated in FIG. 8.

As illustrated in FIGS. 5 and 8, the locking lever 180 and a locking actuator 185 for displacing the connecting pin 134 within the I-shaped elongated hole 133 are assembled on the plate 101. The locking lever 180 includes a first lever piece 181 (see FIG. 10) extending towards the locking actuator 185 relative to the sub-support shaft 103 and a second lever piece 182 (see FIG. 8) extending towards the connecting pin 134 relative to the sub-support shaft 103. An arc-shaped elongated hole 183 is formed at the second lever piece 182 of the locking lever 180 so as to penetrate therethrough. The elongated hole 183 is formed at the second lever piece 182 so as to be overlappable with the I-shaped elongated hole 133 and the L-shaped hole 123. The connecting pin 134 is inserted within the elongated hole 183 so as to be movable therewithin.

The locking actuator 185 is configured with an electric motor, which is actuated in response to a remote operation (i.e. an operation through a remote control key or a master door lock switch), as a main component. The locking actuator 185 includes an output lever 186, which is connected to the first lever piece 181 of the locking lever 180 via a pin and an elongated hole (see FIG. 10). Furthermore, the output lever 186 and the interior lock operating portion 16 are connected to each other so that the output lever 186 is rotated in response to a displacement operation (i.e. a locking/unlocking operation) of the interior lock operating portion 16 (see FIG. 5).

In the case where the locking/unlocking operation of the interior lock operating portion 16 is performed, or in a case where the locking actuator 185 is actuated, the locking lever 180 is rotated about the sub-support shaft 103, so that the connecting pin 134 is displaced between an inner end portion (a first end portion) of the I-shaped elongated hole 133 located closer to the main support shaft 102 (i.e. a position indicated by a solid line in FIG. 8) and an outer end portion (a second end portion) of the I-shaped elongated hole 133 corresponding to an outer end portion of the second side passage 1238 (i.e. a position indicated by a chain double-dashed line in FIG. 8).

For example, in the case where the locking operation of the interior lock operating portion 16 is performed (i.e. in the case where the interior lock operating portion 16 is movably operated in the closing direction of the slide door 90), the locking lever 180 is rotated about the sub-support shaft 103 in the counterclockwise direction in FIG. 8, so that the connecting pin 134 is located at a locking position (i.e. a force transmission interrupting position) corresponding to the outer end portion of the I-shaped elongated hole 133. On the other hand, in the case where the unlocking operation of the interior lock operating portion 16 is performed (i.e. in the case where the interior lock operating portion 16 is movably operated in the opening direction of the slide door 90), the locking lever 180 is rotated about the sub-support shaft 103 in the clockwise direction in FIG. 8, so that the connecting pin 134 is displaced to an unlocking position (i.e. a force transmitting position) corresponding to the inner end portion of the I-shaped elongated hole 133 located closer to the main support shaft 102 in an extended radial direction thereof. In this embodiment, a portion of the I-shaped elongated hole 133 from the inner end portion to an intermediate portion thereof in the longitudinal direction (i.e. a portion of the I-shaped elongated hole 133 that is overlappable with the first side passage 123A) corresponds to the unlocking position. More specifically, the inner end portion of the I-shaped elongated hole 133 in the unlocking position (i.e. a portion of the I-shaped elongated hole 133 that is overlapped with a rotation range of a rotation interfering portion 165) corresponds to a normal unlocking position. On the other hand, the intermediate portion of the I-shaped elongated hole 133 (i.e. apportion of the I-shaped elongated hole 133 located outside of the rotation range of the rotation interfering portion 165) corresponds to an emergency unlocking position. Additionally, while a normal operation state is maintained, the connecting pin 134 is located at either one of the outer end portion and the inner end portion of the I-shaped elongated hole 133, in other words, at either one of the normal unlocking position or the locking position, so that the connecting pin 134 is not stopped at the emergency unlocking position.

In the case where the connecting pin 134 is located at the unlocking position (i.e. in the case where the connecting pin 134 is located at the normal unlocking position or the emergency unlocking position), the connecting pin 134 connects the ratchet interlocking lever 130 and the connecting pin penetrating lever 120 so that the ratchet interlocking lever 130 and the connecting pin penetrating lever 120 are rotatable together as a unit. In other words, in this case, the force is transmittable from the connecting pin penetrating lever 120 to the ratchet interlocking lever 130.

On the other hand, in the case where the connecting pin 134 is located at the locking position, which corresponds to the outer end portion of the I-shaped elongated hole 133, the connecting pin 134 is allowed to be movable within the second side passage 123B in a longitudinal direction thereof while the connecting pin 134 is retained at the locking position. Accordingly, even in the case where the connecting pin penetrating lever 120 is rotated about the main support shaft 102 in the first rotational direction, the force generated by the rotation of the connecting pin penetrating lever 120 is not transmitted to the ratchet interlocking lever 130. As a result, the ratchet interlocking lever 130 remains at the initial position illustrated in FIG. 8.

Figure 12:
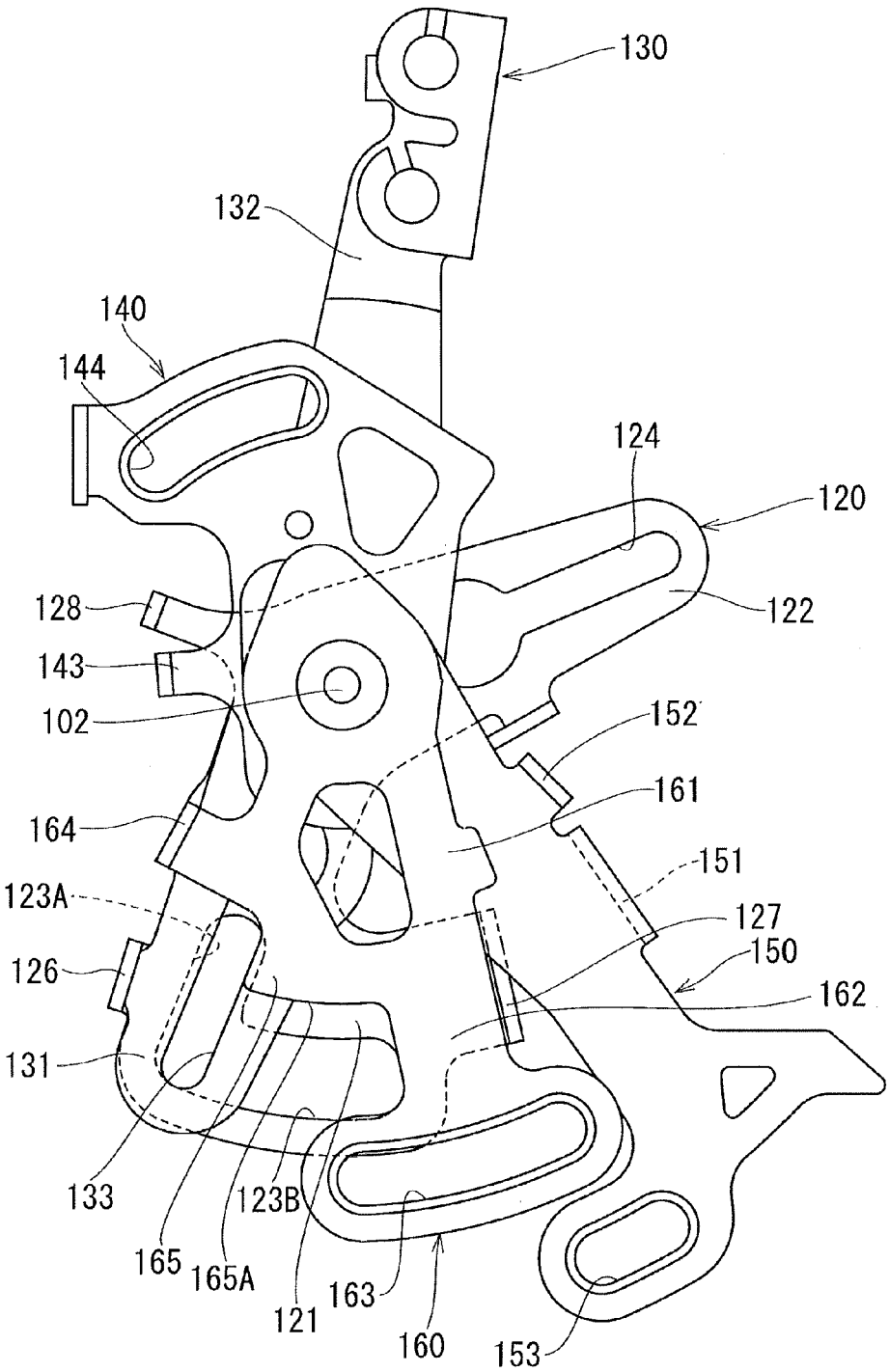
FIG. 12 is a front view of the vehicle door operating mechanism (except for a fully-open lock lever)

As illustrated in FIG. 12, the outer handle connecting lever 150 extends relative to the main support shaft 102 in a direction opposite to the inner handle connecting lever 140. An elongated hole 153 is formed at an end portion of the outer handle connecting lever 150 so as to penetrate therethrough. A slide bush 153B is supported within the elongated hole 153 while allowing the slide bush 153B to be slidable therewithin in a longitudinal direction of the elongated hole 153. An end portion of a fourth open cable 94W extending from the outer door handle 17 is connected to the slide bush 153B (see FIG. 5).

As illustrated in FIG. 12, a portion of a side end portion of the outer handle connecting lever 150 facing in the second rotational direction is orthogonally bent to protrude towards the connecting pin penetrating lever 120 (i.e. towards a backside of paper surface of FIG. 12) in order to form a first interlocking contact piece 151. On the other hand, an end portion of the first lever piece 121 of the connecting pin penetrating lever 120 facing in the second rotational direction is orthogonally bent towards the outer handle connecting lever 150 (i.e. towards a nearside on the paper surface of FIG. 12) in order to form an interlocking contact piece 127.

In the case where the outer door handle 17 is operated to open the slide door 90 (is pulled towards the user), the fourth open cable 94W is pulled towards the outer operating handle 17 by the operating force generated by the operation of the outer door handle 17, so that the outer handle connecting lever 150 is rotated about the main support shaft 102 in the first rotational direction from the initial position. In this case, the interlocking contact piece 127 contacts the first interlocking contact piece 151 (see FIG. 10), so that the connecting pin penetrating lever 120 is pushed in the first rotational direction by the outer handle connecting lever 150. Accordingly, the operating force generated in response to the operation of the outer door handle 17 to open the slide door 90 is transmitted to the connecting pin penetrating lever 120 from the outer handle connecting lever 150 without being influenced by the locking/unlocking state of the slide door 90 (i.e. without being influenced by a position of the connecting pin 134 within the I-shaped elongated hole 133), so that the outer handle connecting lever 150 and the connecting pin penetrating lever 120 are normally rotated together as a unit in the first rotational direction. Furthermore, as described above, in the case where the connecting pin 134 is located at the unlocking position, the connecting pin penetrating lever 120 and the ratchet interlocking lever 130 are connected so as to be rotatable together as the unit. As a result, the operating force generated in response to the opening operation of the outer door handle 17 is transmitted to the ratchet interlocking lever 130 via the outer handle connecting lever 150 and the connecting pin penetrating lever 120.

Additionally, the connecting pin penetrating lever 120, the inner handle connecting lever 140 and the outer handle connecting lever 150 configure a handle interlocking lever.

A release motor 60 (see FIG. 5) is provided at the remote control receiving device 100. The motor power transmitting lever 160, which is configured so as to be rotatable about the main support shaft 102 in the first rotational direction in response to a motor power of the release motor 60 transmitted to the motor power transmitting lever 160, is provided at the vehicle door operating mechanism 100K. The release motor 60 is configured so as to be actuated in the case where the latching of the slide door 90 by means of the latch/ratchet mechanisms 20K is released by a manual operation of the inner door handle 18 or the outer door handle 17. More specifically, for example, the release motor 60 is actuated under a condition where either one of the first switch 110 and the second switch 111 is turned on and the rear lock mechanism 10B is unlatched (a first condition), so as to maintain the latch/ratchet mechanism 20K in the unlatched state until the electric door opening/closing mechanism starts being actuated (i.e. until the slide door 90 starts being electrically slid).

Furthermore, the release motor 60 is actuated under a condition where the slide door 90 is in the unlocked state (i.e. in the case where the connecting pin 134 is located at the normal unlocking position) and the remote operation (i.e. the operation through the remote control key or the operation to the door opening/closing switch provided within the vehicle 300) is performed (i.e. a second condition), in order to rotatably actuate the motor power transmitting lever 160 to unlatch the slide door 90. Additionally, the locking/unlocking state of the slide door 90 (i.e. the position of the connecting pin 134) is detected by a position switch, which is included in the locking actuator 185.

As illustrated in FIG. 12, the motor power transmitting lever 160 is formed so as to extend in a direction opposite to the inner handle connecting lever 140 relative to the main support shaft 102. The motor power transmitting lever 160 includes a base portion 161 and a T-shaped protruding portion 162. The base portion 161 is positioned closer to the main support shaft 102. The T-shaped protruding portion 162 is formed so as to protrude from the base portion 161 in a direction opposite to the main support shaft 102. More specifically, the T-shaped protruding portion 162 is formed so as to protrude from an end portion of the base portion 161 positioned closer in the second rotational direction. An arc-shaped elongated hole 163 centering on the main support shaft 102 is formed at an end portion of the T-shaped protruding portion 162 so as to penetrate therethrough. A slide bush 163B is slidably supported within the elongated hole 163. An end portion of a fifth open cable 95W extending from the release motor 60 is connected to the slide bush 163B (see FIG. 5). Accordingly, in the case where the release motor 60 is actuated, the fifth open cable 95W is pulled towards the release motor 60 in response to the force generated by the release motor 60. As a result, the motor power transmitting lever 160 is rotated about the main support shaft 102 in the first rotational direction.

A portion of the side end portion of the outer handle connecting lever 150 facing in the second rotational direction is orthogonally bent towards the motor power transmitting lever 160 (i.e. towards the nearside of a reader on the paper surface of FIG. 12) in order to form a second interlocking contact piece 152 at a position differing from the first interlocking contact piece 151, more specifically, at a position closer to the main support shaft 102 relative to the first interlocking contact piece 151. The second interlocking contact piece 152 is formed so as to be contactable with the side end portion of the motor power transmitting lever 160 facing in the second rotational direction. Additionally, a portion of a side end portion of the base portion 161 of the motor power transmitting lever 160 facing in the second rotational direction is orthogonally bent towards the fully-open lock lever 170 (towards the nearside of the reader on the paper surface of FIG. 12) in order to form an interlocking contact piece 164. A portion of an side end portion of the first lever piece 171 of the fully-open lock lever 170 facing in the first rotational direction is orthogonally bend towards the motor power transmitting lever 160 (i.e. towards a backside of the paper surface of FIG. 8) in order to form an interlocking contact piece 173. The interlocking contact piece 173 is contactable with the interlocking contact piece 164.

In the case where the outer handle connecting lever 150 is rotated in the first rotational direction in response to the opening operation of the outer door handle 17, the motor power transmitting lever 160 is pushed by the second interlocking contact piece 152 so as to be rotated in the first rotational direction, and simultaneously, the fully-open lock lever 170 is pushed by the motor power transmitting lever 160 so as to be rotated in the first rotational direction. Furthermore, in the case where the release motor 60 is actuated, the motor power transmitting lever 160 is actuated to rotate in the first rotational direction while being disconnected from the outer handle connecting lever 150, so that the fully-open lock lever 170 is pushed by the motor power transmitting lever 160 so as to be rotated in the first rotational direction. Still further, the coil spring 176, which biases the fully-open lock lever 170 in the second rotational direction (see FIG. 5), biases the motor power transmitting lever 160 and the outer handle connecting lever 150 in the second rotational direction, so that a stopper 104 (see FIG. 5) provided at the plate 101 contacts the outer handle connecting lever 150, which results in locating the outer handle connecting lever 150, the motor power transmitting lever 160 and the fully-open lock lever 170 in the respective initial positions illustrated in FIGS. 5 and 8.

As illustrated in FIG. 12, a portion of the base portion 161 of the motor power transmitting lever 160 protruding in the first rotational direction relative to the T-shaped protruding portion 162 serves as the rotation interfering portion 165. The rotation interfering portion 165 is formed so as to have a substantially sectoral shape centering on the main support shaft 102. Furthermore, the rotation interfering portion 165 is formed so as to extend along one side of the I-shaped elongated shape extending in the longitudinal direction thereof so as to protrude in the rotating radial direction. An end portion of the rotation interfering portion 165 in the rotating radial direction serves as a guide portion 165A having an arc shape centering on the main support shaft 102. The guide portion 165A is formed at the rotation interfering portion 165 so as to be positioned between a position corresponding to the end portion of the first side passage 123A located closer to the main support shaft 102 and the second side passage 123B. In other words, the guide portion 165A of the rotation interfering portion 165 is located at the position closer to the main support shaft 102 relative to the side portion of the second side passage 123B located closer to the main support shaft 102. Furthermore, the rotation interfering portion 165 is formed so that a rotation range thereof overlaps with the inner end portion of the I-shaped elongated hole 133. On the other hand, the intermediate portion and the outer end portion of the I-shaped elongated hole 133 are located outside of the rotation range of the rotation interfering portion 165. In other words, the rotation interfering portion 165 is formed so as to be allowed to push the connecting pin 134 in the first rotational direction in the case where the connecting pin 134 is located at the normal unlocking position. On the other hand, in the case where the connecting pin 134 is located at the emergency unlocking position and the locking position, the rotation interfering portion 165 is not allowed to push the connecting pin 134 in the first rotational direction.

Described above is the configuration of the vehicle door operating mechanism 100K according to the first embodiment. An operation of the vehicle door operating mechanism 100K will be described below. In the case where the inner door handle 18 is operated to close the slide door 90 (i.e. the inner door handle 18 is tilted in the closing direction) while the slide door 90 is in the fully-opened state, the first rod 105 pushes the fully-open lock lever 170 so as to rotate the fully-open lock lever 170 about the main support shaft 102 in the first rotational direction (i.e. in the clockwise direction in FIG. 8). Accordingly, the third open cable 93W, which is connected to the fully-open lock lever 170, is pulled towards the remote control receiving device 100, so that the retention of the slide door 90 in the fully-opened state by means of the latch/ratchet mechanism of the fully-open door lock mechanism 10C is lifted. As a result, the slide door 90 is turned from the fully-opened state to the state where the slide door 90 is electrically or manually slidable in the closing direction.

In the case where the outer door handle 17 is operated to close the slide door 90 (i.e. the outer door handle 17 is pulled towards the user) while the slide door 90 is in the fully-opened state, the outer handle connecting lever 150 is pulled by the fourth open cable 94W so as to be rotated in the first rotational direction. Furthermore, in this case, the connecting pin penetrating lever 120, the motor power transmitting lever 160 and the fully-open lock lever 170 are pushed by the outer handle connecting lever 150 so as to be rotated as a unit about the main support shaft 102 in the first rotational direction. The third open cable 93W is pulled towards the remote control receiving device 100 in response to the rotation of the fully-open lock lever 170 in the first rotational direction, so that the retention of the slide door 90 in the fully-opened state by means of the fully-open door lock mechanism 100 is released. Accordingly, the slide door 90 is turned from the fully-opened state to the state where the slide door 90 is electrically or manually slidable in the closing direction.

Furthermore, in the case where the remote operation (i.e. the operation through the remote control key or the operation to the door opening/closing switch provided within the vehicle 300) is performed without operating the outer door handle 17 or the inner door handle 18 while the slide door 90 is in the fully-opened state, the release motor 60 is actuated and the motor power transmitting lever 160 is rotatably actuated in the first rotational direction. Accordingly, the motor power transmitting lever 160 pushes the fully-open lock lever 170 so as to rotate the fully-open lock lever 170 in the first rotational direction together with the motor power transmitting lever 160 as the unit (see FIG. 10). Consequently, the third open cable 93W is pulled towards the remote control receiving device 100, thereby releasing the retention of the slide door 90 in the fully-opened state by the fully-open door lock mechanism 100. As a result, the slide door 90 becomes electrically slidable in the closing direction.

An operation of the vehicle door operating mechanism 100K in the case where the operation of opening the slide door 90, which is retained to be closed, is performed will be described below under an assumption that the child lock is in the unlocked state (i.e. the child lock pin 125 is located at the position illustrated by the solid line in FIG. 8).

Figure 9:
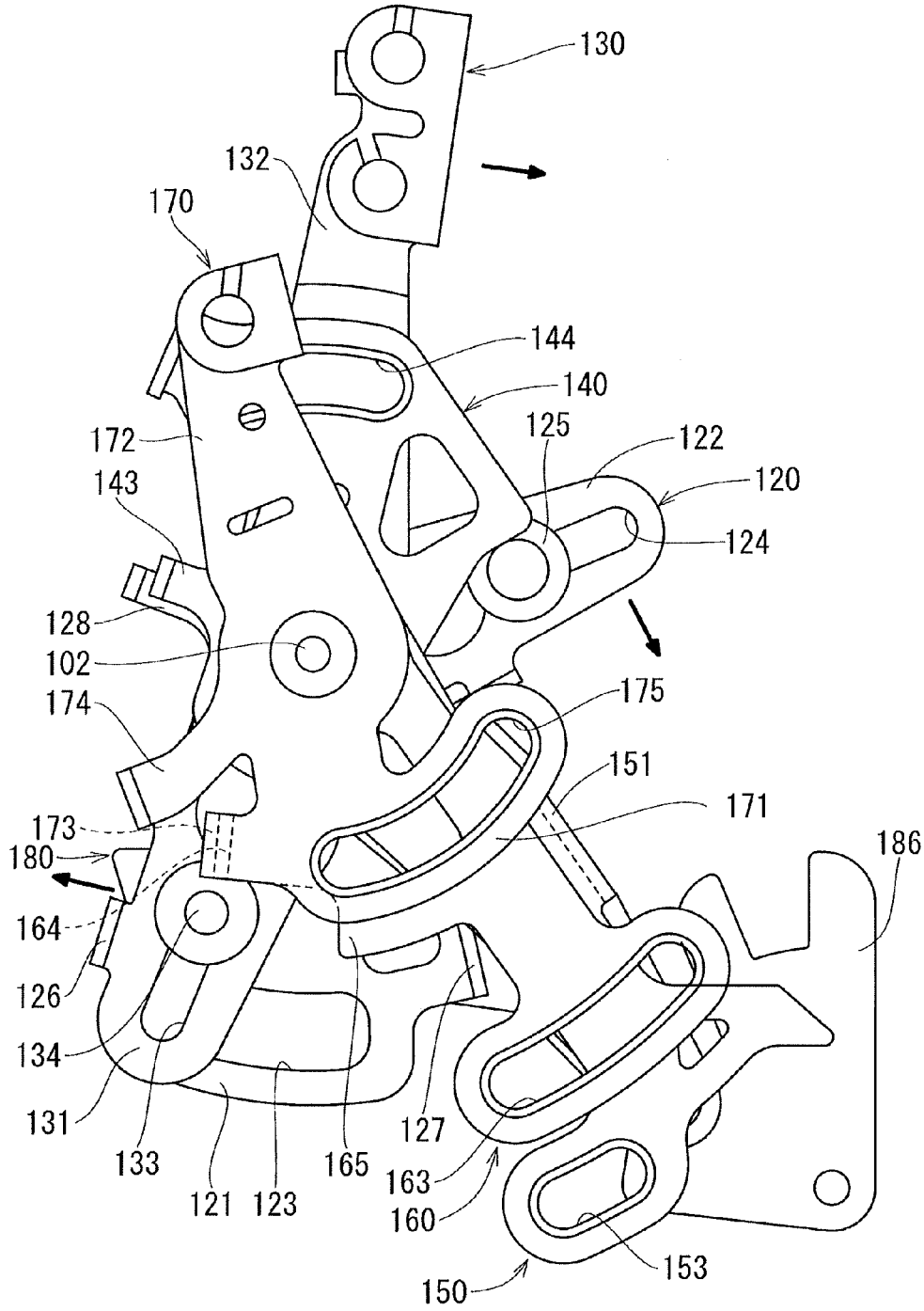
FIG. 9 is a front view of the vehicle door operating mechanism in a case where an inner door handle is operated to open the slide door.

In a case where the slide door 90 is turned to be in the unlocked state (i.e. the position of the connecting pin 134 is shifted to the normal unlocking position illustrated by the solid line in FIG. 8) and the inner door handle 18 is operated to open the slide door 90, the inner handle connecting lever 140 is rotated about the main support shaft 102 in the first rotational direction so as to push the child lock pin 125, thereby rotating the connecting pin penetrating lever 120 in the first rotational direction (the state of the vehicle door operating mechanism 100K is shifted from the state in FIG. 8 to the state in FIG. 9). The rotation of the connecting pin penetrating lever 120 is transmitted to the ratchet interlocking lever 130 via the connecting pin 134, so that the ratchet interlocking lever 130 is rotated in the first rotational direction and simultaneously, the first and second open cables 91W and 92W are pulled towards the remote control receiving device 100. Then, when the ratchet interlocking lever 130 reaches the vicinity of a rotation end position, which is displaced away from the initial position in the first rotational direction, the latching of the slide door 90 by means of the latch/ratchet mechanisms 10K of the respective front lock mechanism 10A and the rear lock mechanism 10B is released (see FIG. 3). Simultaneously, the first operation condition of the release motor 60 is satisfied.

Figure 11:
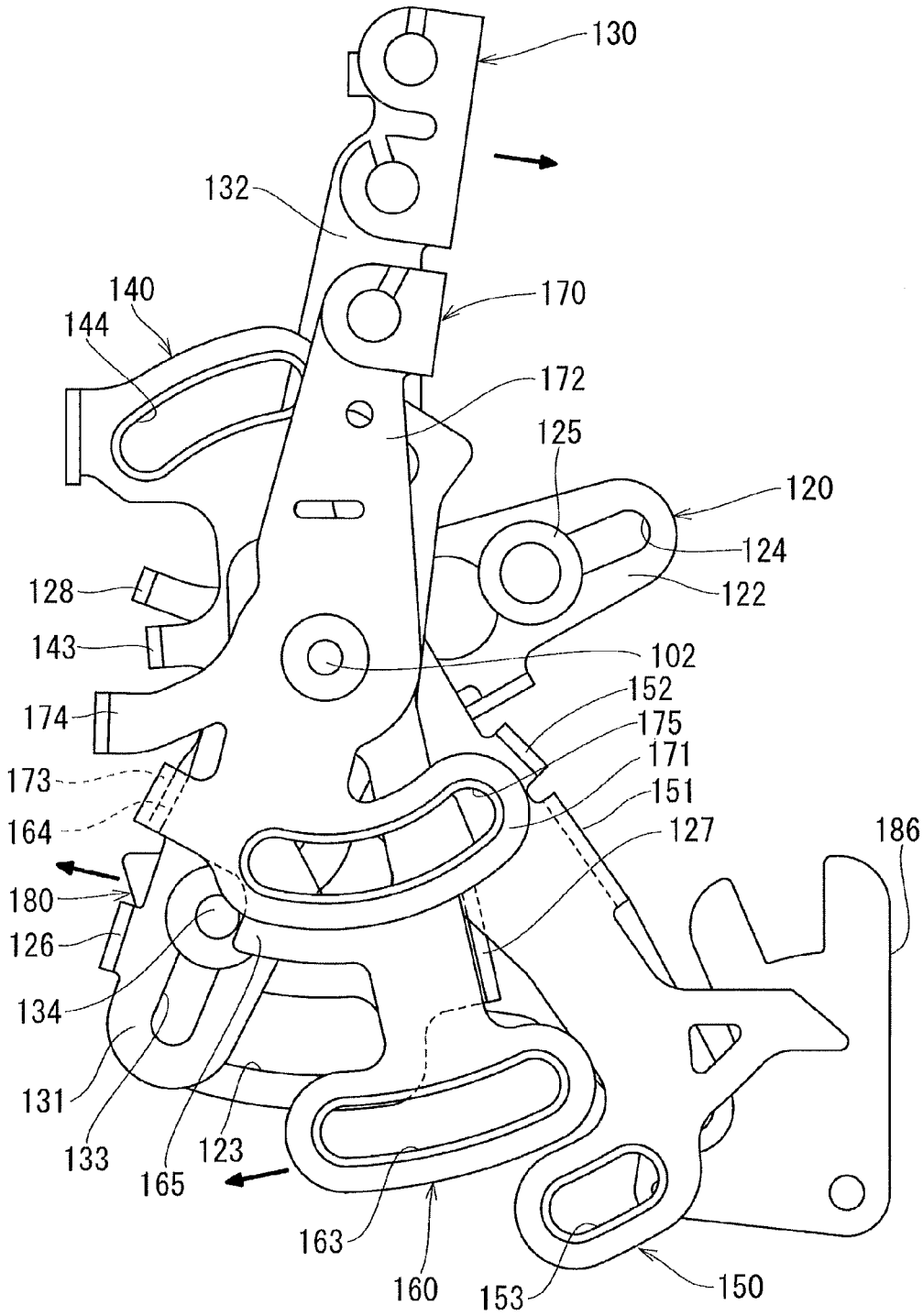
FIG. 11 is a front view of the vehicle door operating mechanism in a case where a release motor is actuated.

Accordingly, the motor power transmitting lever 160 is actuated to rotate in the first rotational direction by the release motor 60, so that the state where the rotation interfering portion 165 contacts the connecting pin 134 as illustrated in FIG. 11 is maintained. In other words, the connecting pin penetrating lever 120, the ratchet interlocking lever 130 and the motor power transmitting lever 160 are retained at respective rotation end positions, which are located away from the respective initial positions in the first rotational direction, by the motor power of the release motor 60. As a result, even in a case where the user releases his/her hand from the inner door handle 18 and the inner handle connecting lever 140 is returned to the initial position, the unlatching state by the latch/ratchet mechanisms 20K may be maintained until the electric door opening/closing mechanism starts being actuated (i.e. until the slide door 90 is started being electrically slid).

Figure 10:
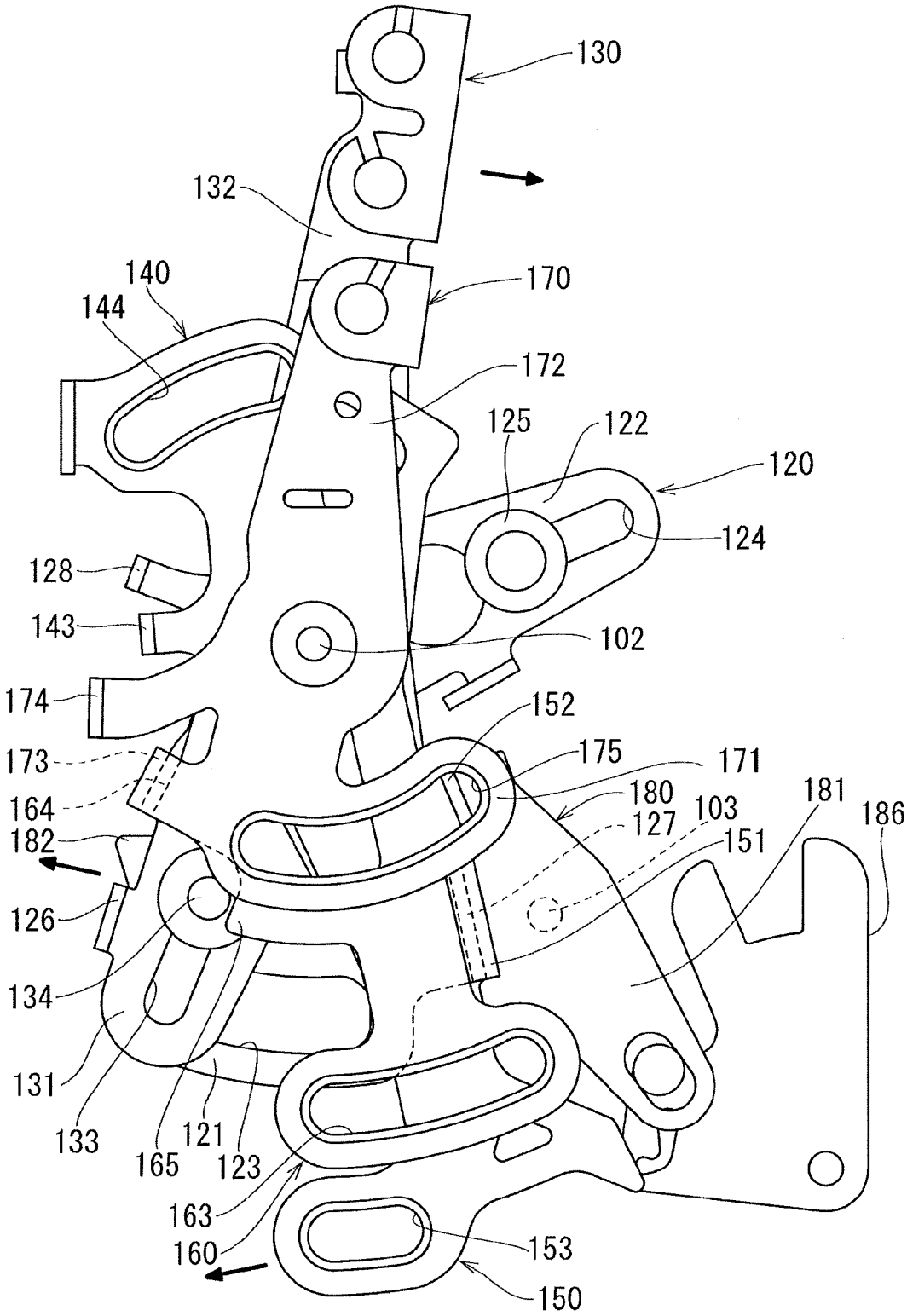
FIG. 10 is a front view of the vehicle door operating mechanism in a case where an outer door handle is operated to open the slide door.

On the other hand, in the case where the slide door 90 is turned to be in the unlocked state and the outer door handle 17 is operated to open the slide door 90 (i.e. the outer door handle 17 is pulled towards the user), the outer handle connecting lever 150 is rotated about the main support shaft 102 in the first rotational direction (the state of the vehicle door operating mechanism 100K is shifted from the state illustrated in FIG. 8 to a state illustrated in FIG. 10). In this case, the outer handle connecting lever 150 pushes the connecting pin penetrating lever 120 and the motor power transmitting lever 160. Furthermore, because the connecting pin penetrating lever 120 and the ratchet interlocking lever 130 are connected to each other via the connecting pin 134, the operating force generated in response to the opening operation of the outer door handle 17 is transmitted to the ratchet interlocking lever 130 via the outer handle connecting lever 150 and the connecting pin penetrating lever 120, so that the connecting pin penetrating lever 120, the ratchet interlocking lever 130 and the outer handle connecting lever 150 are rotated together as the unit about the main support shaft 102 in the first rotational direction.

The first and second open cables 91W and 92W are pulled towards the remote control receiving device 100 in response to the rotation of the ratchet interlocking lever 130 in the first rotational direction. Then, when the ratchet interlocking lever 130 reaches the vicinity of the rotation end position, which is located away from the initial position thereof in the first rotational direction, the latching of the slide door 90 by means of the latch/ratchet mechanisms 20K of the respective front lock mechanism 10A and the rear lock mechanism 10B is released (see FIG. 3) and the first operation condition of the release motor 60 is established. Accordingly, the rotation interfering portion 165 of the motor power transmitting lever 160 is pressed against the connecting pin 132 in response to the motor power generated by the release motor 60, so that the connecting pin penetrating lever 120, the ratchet interlocking lever 130 and the motor power transmitting lever 160 are retained at the respective rotation end positions, which are located away from the respective initial positions in the first rotational direction. As a result, even in a case where the user releases his/her hand from the outer door handle 17 and the outer handle connecting lever 150 is returned to the initial position thereof (see FIG. 11), the unlatching state of the slide door 90 by the latch/ratchet mechanisms 20K may be maintained until the electric door opening/closing mechanism starts being actuated (i.e. until the slide door 90 starts electrically being slid).

In a case where the slide door 90 is turned to be in the unlocked state and the remote operation is performed without performing the opening operation of the outer door handle 17 or the inner door handle 18, the second operation condition of the release motor 60 is established. Therefore, the ratchet interlocking lever 130 and the motor power transmitting lever 160 are actuated to rotate from the respective initial positions to the respective rotation end positions in the first rotational direction only by the motor power of the release motor 60 (i.e. the state of the vehicle door operating mechanism 100K is shifted from the state illustrate din FIG. 8 to a state illustrated in FIG. 11). Then, as described above, the latching of the slide door 90 by means of the latch/ratchet mechanisms 20K of the respective front lock mechanism 10A and the rear lock mechanism 10B is released. Accordingly, the unlatching state of the slide door 90 by means of the latch/ratchet mechanisms 20K of the respective front lock mechanism 10A and the rear lock mechanism 10B may be maintained until the electric door opening/closing mechanism starts being actuated (i.e. until the slide door 90 starts being electrically slid).

While both of the slide door 90 and the child lock are in the unlocked state, the slide door 90 is openable in response to the opening operation of the inner door handle 18, the opening operation of the outer door handle 17, the remote operation of the remote control key or the like.

In a case where the inner door handle 18 is operated to open the slide door 90 while the slide door 90 is in the locked state (i.e. while the connecting pin 134 is located at the locking position indicated by the chain double-dashed line in FIG. 8), the connecting pin penetrating lever 120 and the inner handle connecting lever 140 are rotated in the first rotational direction in response to the operating force generated when the inner door handle 18 is operated. However, because the connecting pin 134 is allowed to be displaced within the second side passage 123B while the connecting pin 134 is retained at the locking position within the I-shaped elongated hole 133, the transmission of the power from the connecting pin penetrating lever 120 to the ratchet interlocking lever 130 is interrupted. In other words, the operating force generated in response to the opening operation of the inner door handle 18 is not transmitted to the ratchet interlocking lever 130. Therefore, the ratchet interlocking lever 130 is retained at the initial position illustrated in FIG. 8. Accordingly, the retention of the slide door 90 in the closed state by means of the front lock mechanism 10A and the rear lock mechanism 10B is maintained.

In a case where the outer door handle 17 is operated to open the slide door 90 while the slide door 90 is in the locked state, the outer handle connecting lever 150 is rotated in the first rotational direction and the connecting pin penetrating lever 120 is pushed by the outer handle connecting lever 150 so as to be rotated in the first rotational direction together with the outer handle connecting lever 150 as a unit. However, because, in this case, the connecting pin penetrating lever 120 is allowed to be displaced within the second side passage 123B, the power transmission from the connecting pin penetrating lever 120 to the ratchet interlocking lever 130 is interrupted. In other words, the operating force generated in response to the opening operation of the outer door handle 17 is not transmitted to the ratchet interlocking lever 130. Therefore, the ratchet interlocking lever 130 is retained at the initial position illustrated in FIG. 8. Accordingly, the retention of the slide door 90 in the closed state by means of the front lock mechanism 10A and the rear lock mechanism 10B is maintained.

The release motor 60 is not actuated even if the remote operation is performed while the slide door 90 is in the locked state. Therefore, the ratchet interlocking lever 130, the motor power transmitting lever 160 and the like are retained at the corresponding initial positions illustrated in FIG. 8 and the retention of the slide door 90 in the closed state by means of the front lock mechanism 10A and the rear lock mechanism 10B is maintained.

In the case where the slide door 90 is in the locked state, the slide door 90 is not openable even by the operation of the outer door handle 17, the operation of the inner door handle 18, the remote operation through the remote control key or the like.

Additionally, in a case where the inner door handle 18 is operated to open the slide door 90 while the child lock is in the locked state (i.e. while the child lock pin 125 is located at the position indicated by the chain double-dashed line in FIG. 8), the inner handle connecting lever 140 is rotated in the first rotational direction by the operating force generated by the inner door handle 18. However, because the child lock pin 125 is located at the child lock position so as not to contact the inner handle connecting lever 140, the operating force generated in response to the operation of the inner door handle 18 is not transmitted to the connecting pin penetrating lever 120 and the ratchet interlocking lever 130. Accordingly, the connecting pin penetrating lever 120 and the ratchet interlocking lever 130 are retained at the respective initial positions illustrated in FIG. 8, so that the retention of the slide door 90 in the closed state by means of the front lock mechanism 10A and the rear lock mechanism 10B is maintained without being influenced by the locking/unlocking state of the slide door 90. The locked state of the child lock is applicable relative to the opening operation of the inner door handle 18. Therefore, in a case where the slide door 90 is in the unlocked state while the child lock is in the locked state, the slide door 90 is openable by the opening operation of the outer door handle 17 or the remote operation through the remote control key and the like.

As illustrated in FIG. 11, for example, in a case where the ratchet interlocking lever 130 and the motor power transmitting lever 160 become immovable while being positioned at the respective rotation end positions, which are located away from the respective initial positions in the first rotational direction (or while the ratchet interlocking lever 130 and the motor power transmitting lever 160 are in a process of being displaced in the first rotational direction from the respective initial positions), because of a malfunction of the release motor 60, a defect on a transmission path of the motor power and the like, the latch/ratchet mechanisms 20K are not returnable from the state where the retention of the slide door 90 in the closed state is released (i.e. the state where the ratchet 30 is located at a position indicated by a chain double-dashed line in FIG. 4).

Figure 14:
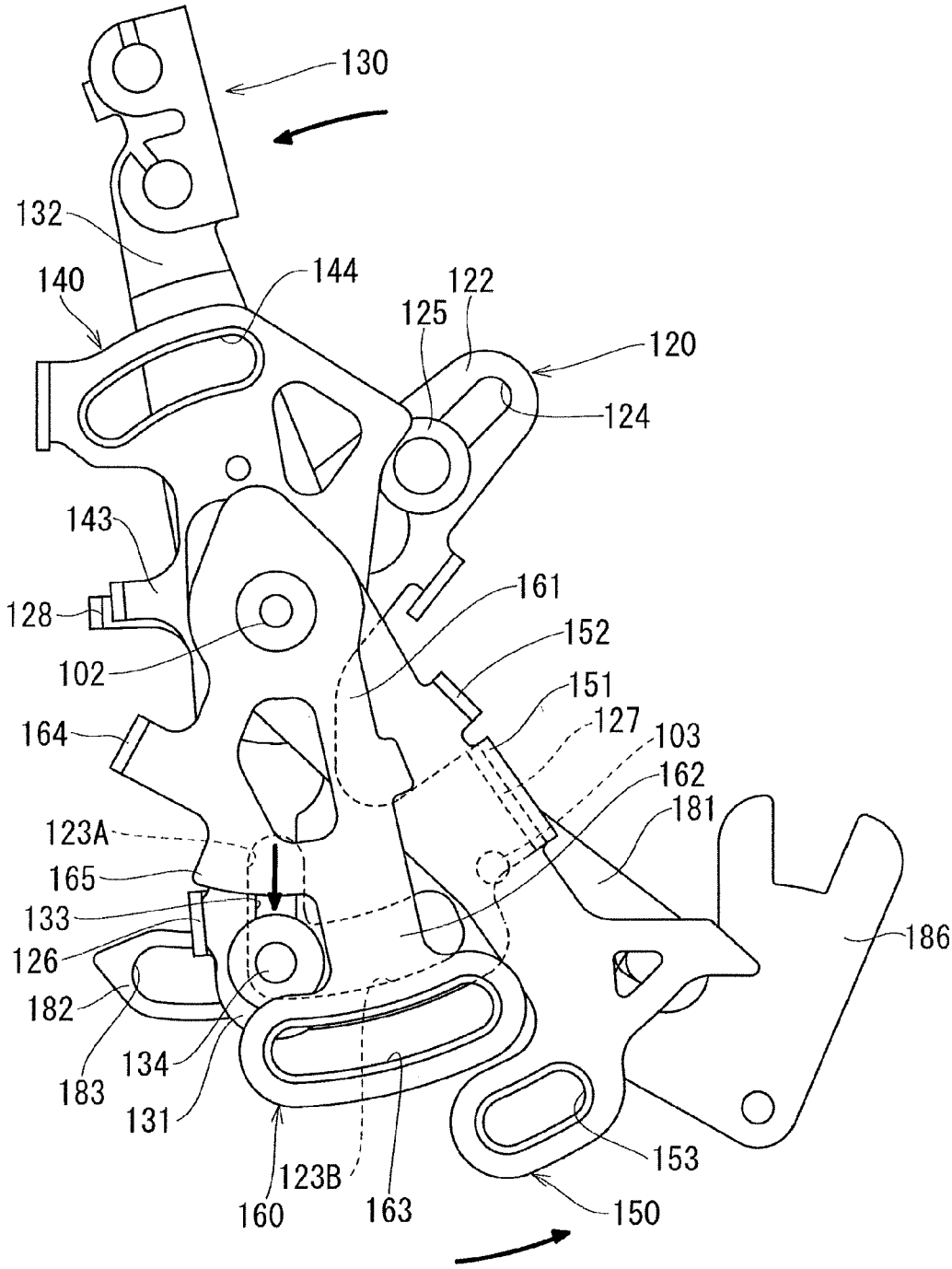
FIG. 14 is a front view of the vehicle door operating mechanism in a case where a motor disconnecting operation is performed in response to an abnormal stoppage of a motor power transmitting lever.

In the above mentioned emergency case, a locking operation may be performed relative to the interior lock operating portion 16 (i.e. the interior lock operating portion 16 may be movably operated in the closing direction of the slide door 90). Accordingly, as illustrated in FIG. 14, the connecting pin 134 is displaced from the normal unlocking position to the locking position so as to be positioned outside of the rotation range of the rotation interfering portion 165. As a result, the motor power transmitting lever 160 is disconnected from the connecting pin penetrating lever 120 and the ratchet interlocking lever 130 (i.e. the release motor 60 is disconnected from the latch/ratchet mechanisms 20K), so that the connecting pin penetrating lever 120 and the ratchet interlocking lever 130 are integrally rotated together as the unit in the second rotational direction by the biasing force of the torsion coil spring 129 so as to be returned to the perspective initial positions. Consequently, the first and second open cables 91W and 92W are returned towards the latch/ratchet mechanisms 20K provided at the front lock mechanism 10A and the rear lock mechanism 10B, respectively, in order to return the latch/ratchet mechanisms 20K to be in the state where the slide door 90 is retainable to be in the closed state.

In the case where the slide door 90, which is retained to be in the closed state, is opened by the above-described disconnecting operation of the release motor 60 (i.e. the locking operation by the interior lock operating portion 16, a motor disconnecting operation), the unlocking operation may be performed through the interior lock operating portion 16. More specifically, the rotation interfering portion 165 of the motor power transmitting lever 160 overlaps with the inner end portion of the I-shaped elongated hole 133 (the normal unlocking position) as illustrated in FIG. 14 at a point of time when the motor disconnecting operation is performed. In a case where the unlocking operation of the interior lock operating portion 16 is performed while the above-mentioned state is established, the connecting pin 134 is displaced towards the inner end portion of the I-shaped elongated hole 133 from the locking position so as to contact the guide portion 165A of the rotation interfering portion 165. As a result, the connecting pin 134 is retained at the emergency unlocking position, which is located between the locking position and the normal unlocking position (i.e. at the intermediate portion of the I-shaped elongated hole 133) (see FIG. 15). While the connecting pin 134 is located at the emergency unlocking position, the connecting pin 134 is positioned within the first side passage 123A (i.e. at the unlocking position). Therefore, the force becomes transmittable from the connecting pin penetrating lever 120 to the ratchet interlocking lever 130. On the other hand, because the connecting pin 134 is positioned outside of the rotation range of the rotation interfering portion 165, the motor power transmitting lever 160 is turned to be in the state where the motor power transmitting lever 160 is disconnected from the connecting pin penetrating lever 120 and the ratchet interlocking lever 130 (i.e. the state where the release motor 60 is disconnected from the latch/ratchet mechanisms 20K).

Figure 15:
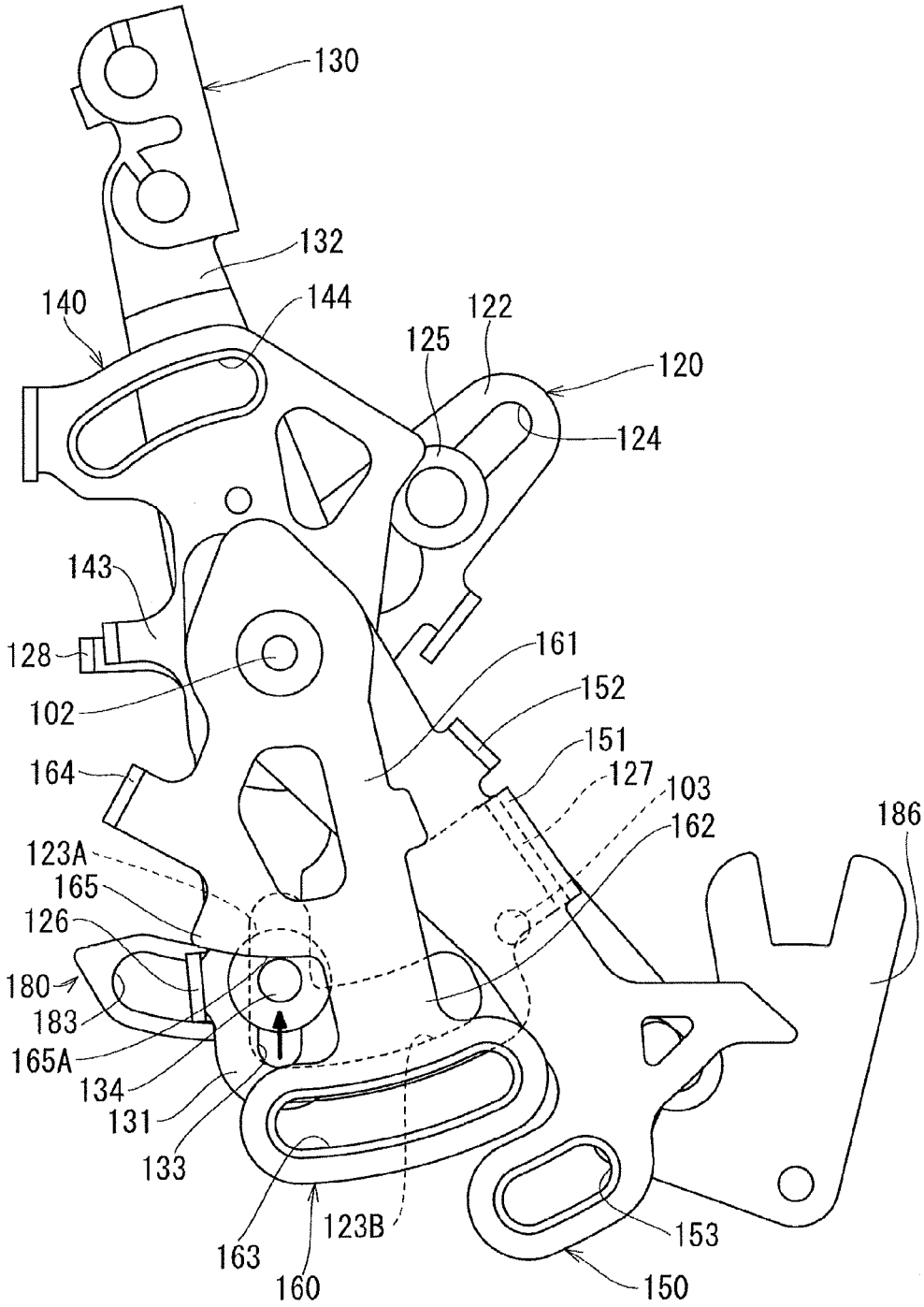
FIG. 15 is a front view of the vehicle door operating mechanism in a case where a connecting pin is positioned at an emergency unlocking position.
Figure 16:
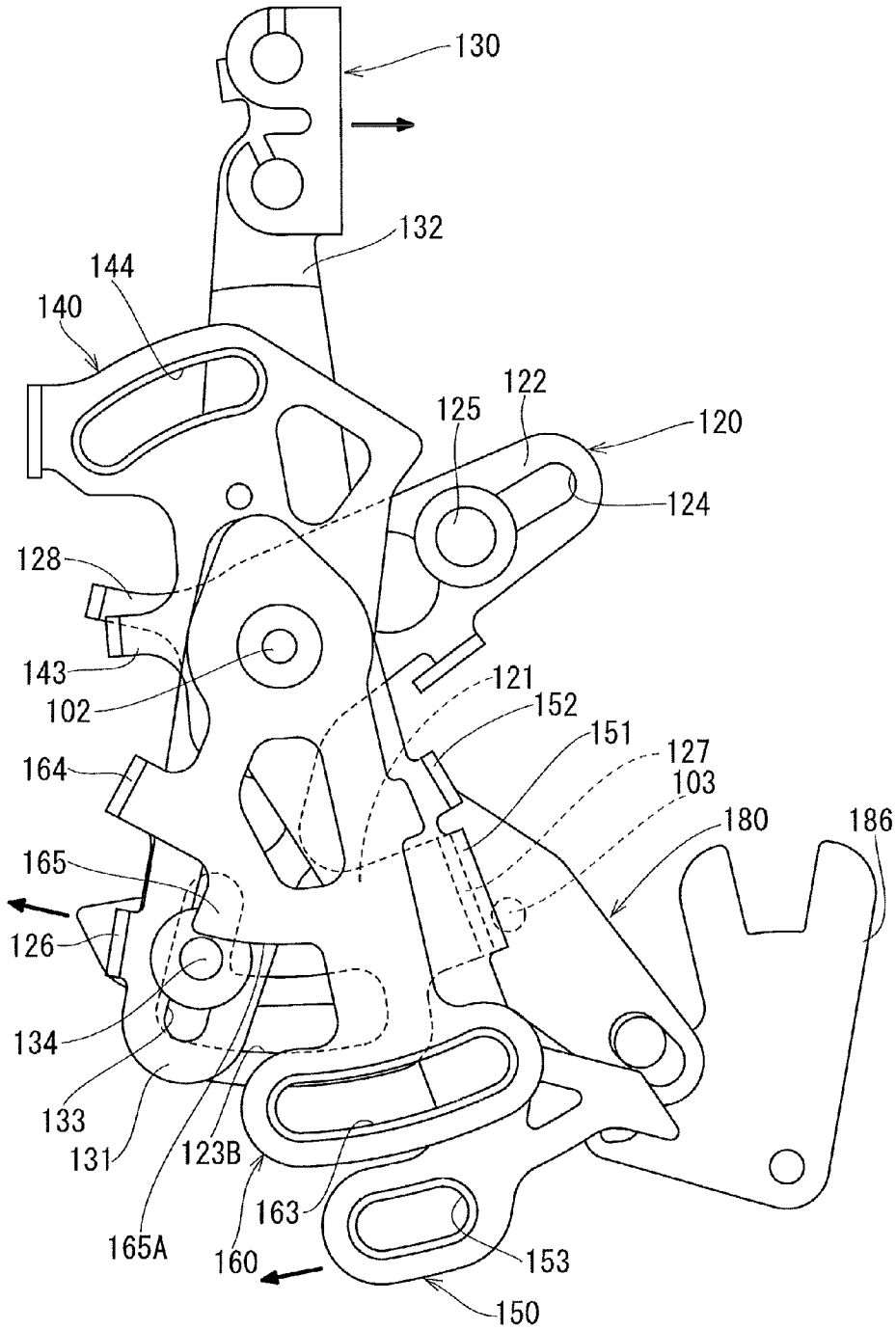
FIG. 16 is a front view of the vehicle door operating mechanism in a case where the connecting pin is positioned at the emergency unlocking position and the outer door handle is operated to open the slide door.
Figure 17:
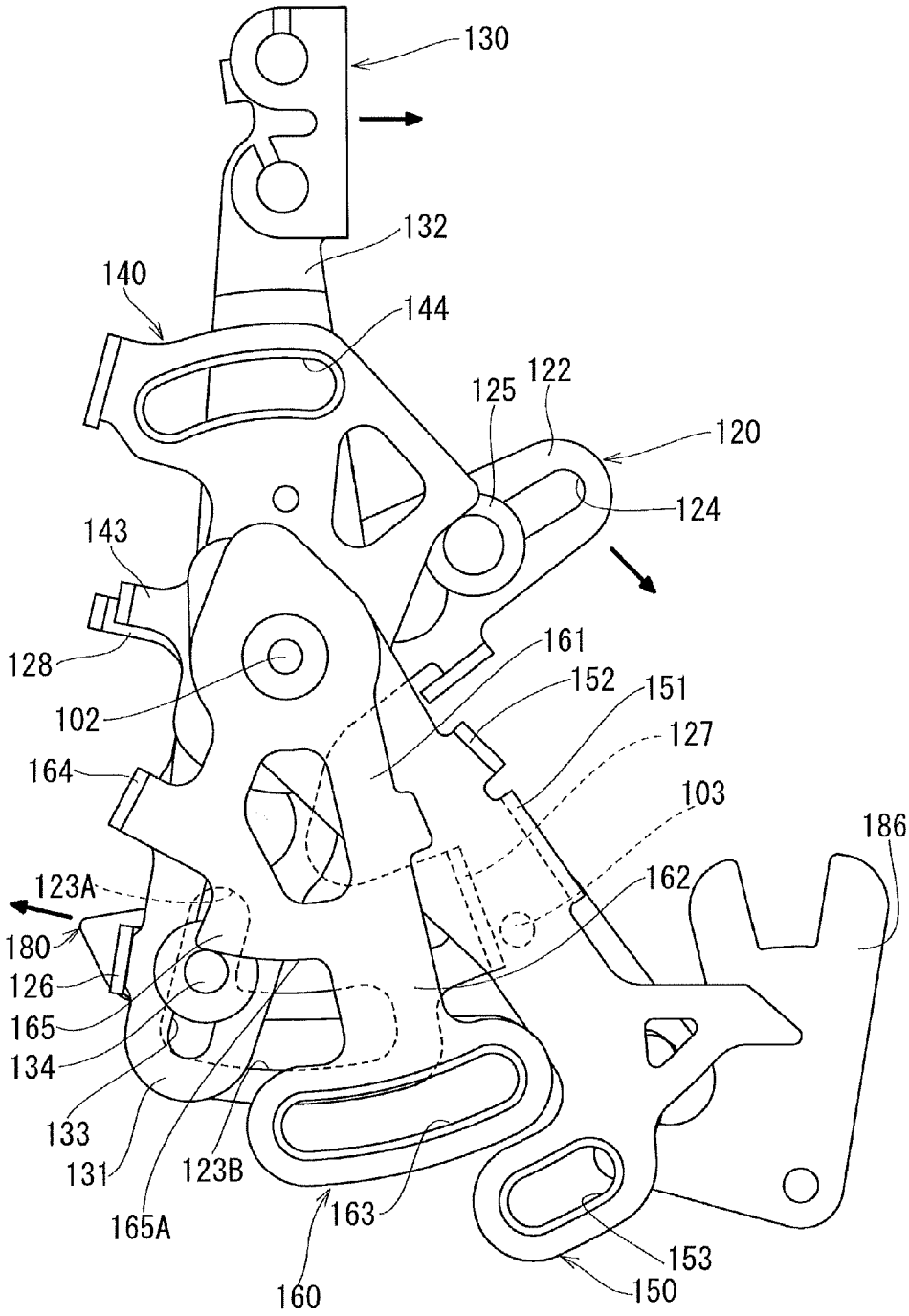
FIG. 17 is a front view of the vehicle door operating mechanism in a case where the connecting pin is positioned at the emergency unlocking position and the inner door handle is operated to open the slide door.
Figure 18:
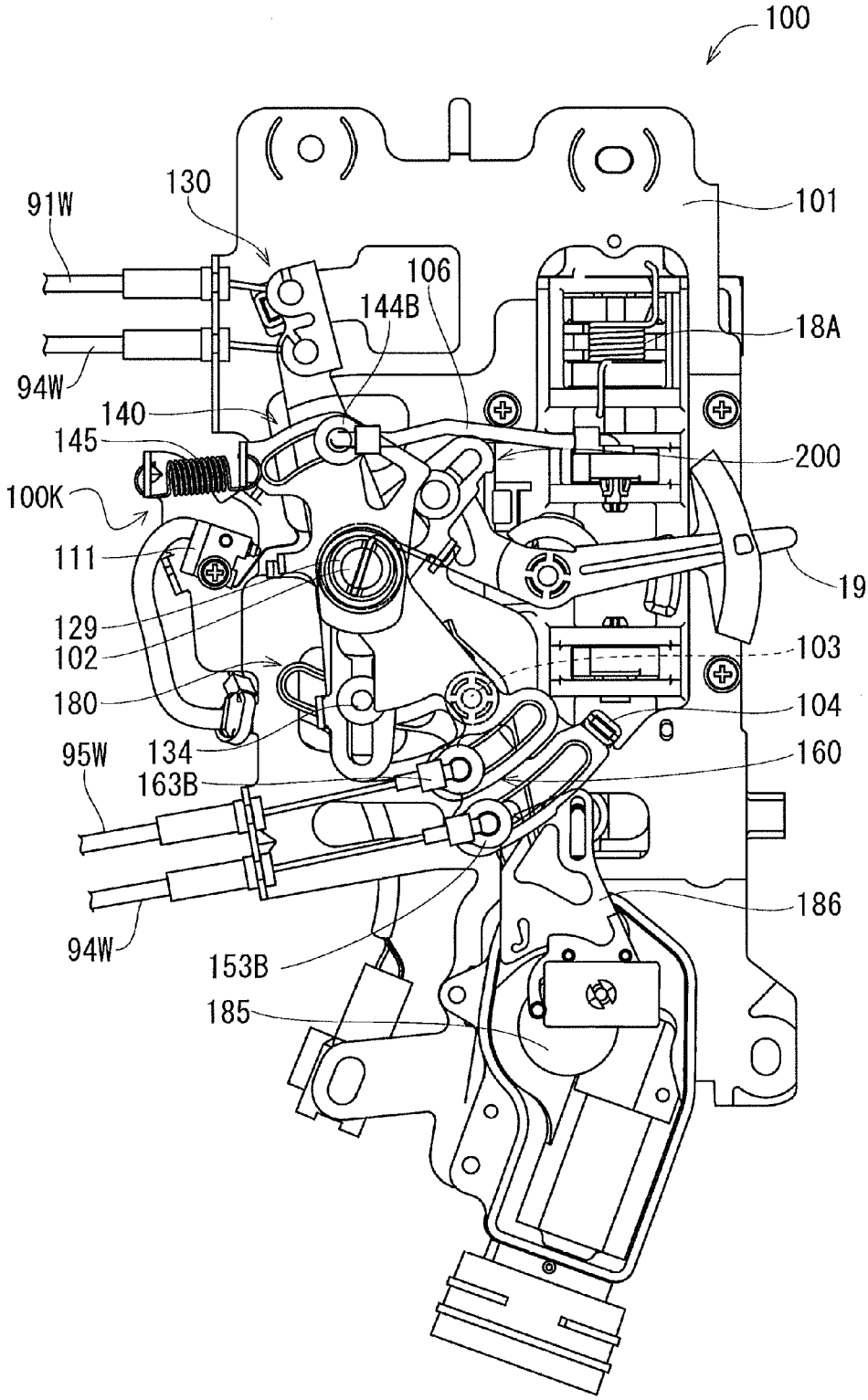
FIG. 18 is a front view of a remote control receiving device having a vehicle door operating mechanism according to a second embodiment.

In a case where the outer door handle 17 is operated to open the slide door 90 while the connecting pin 134 is located at the emergency unlocking position, the connecting pin 134 is slid along the guide portion 165A of the rotation interfering portion 165, so that the connecting pin penetrating lever 120, the ratchet interlocking lever 130 and the outer handle connecting lever 150 are rotated together as the unit in the first rotational direction while the motor power transmitting lever 160 (i.e. the release motor 60), which is stopped because of an abnormal state thereof, is disconnected from the latch/ratchet mechanisms 20K, thereby pulling the first and second open cables 91W and 92W towards the remote control receiving device 100 (the state of the vehicle door operating mechanism 100K is shifted from a state illustrated in FIG. 15 to a state illustrated in FIG. 16). Accordingly, the retention of the slide door 90 in the closed state by means of the latch/ratchet mechanisms 20K of the respective front lock mechanism 10A and the rear lock mechanism 10B is released, so that the slide door 90 is allowed to be manually opened. Additionally, because the locking state of the child lock is not applicable to (effect on) the opening operation of the outer door handle 17, the retention of the slide door 90 in the closed state may be released in response to the opening operation of the outer door handle 17, so that the slide door 90 may become openable without being influenced by the locking/unlocking state of the child lock.

Furthermore, in the case where the child lock is in the unlocked state, the slide door 90 may be opened in response to the opening operation of the inner door handle 18. In other words, in the case where the inner door handle 18 is operated to open the slide door 90, the connecting pin 134 is slid along the guide portion 165A of the rotation interfering portion 165, so that the connecting pin penetrating lever 120, the ratchet interlocking lever 130 and the inner handle connecting lever 140 are rotated together as the unit in the first rotational direction (i.e. the state of the vehicle door operating mechanism 100K is shifted from the state illustrated in FIG. 15 to a state illustrated in FIG. 17). Accordingly, the retention of the slide door 90 in the closed state by means of the latch/ratchet mechanisms 20K of the respective front lock mechanism 10A and the rear lock mechanism 10B is released, so that the slide door 90 may be allowed to be manually opened.

According to the vehicle door operating mechanism 100K of this embodiment, in the case where the ratchet interlocking lever 130 and the motor power transmitting lever 160 are abnormally stopped and become immovable in the process of being displaced towards the respective rotation end positions or in the first rotational direction because of the malfunction of the release motor 60, the defect on the transmission path of the motor power and the like, the locking operation may be performed to the interior lock operating portion 16 in order to displace the connecting pin 134 from the normal unlocking position to the locking position. Accordingly, the power transmission from the motor power transmitting lever 160 to the connecting pin penetrating lever 120 and the ratchet interlocking lever 130 is interrupted, so that the release motor 60 having the defect on the transmission path of the motor power or the release motor 60 having the malfunction is disconnected from the latch/ratchet mechanisms 20K. As a result, the ratchet interlocking lever 130 may be returned to the initial position thereof, which may further result in returning the slide door 90 to be in the state where the slide door 90 is retainable to be in the closed state. Furthermore, because the interior lock operating portion 16, which is normally used for locking and unlocking the slide door 90, is configured so as to serve also as an operation target of the motor disconnecting operation, the slide door 90 may be promptly returned to the state where the slide door 90 is retainable to be in the closed state by the operation of the interior lock operating portion 16 in a process of trial and error without checking a vehicle manual book and the like in the case of the emergency where the slide door 90 is not retainable to be in the closed state because of the malfunction of the release motor 60 and the like. Still further, because the vehicle door operating mechanism 100K of this embodiment does not need any specific tool to perform the motor disconnecting operation, the slide door 90 may be promptly returned to the state where the slide door 90 is retainable to be in the closed state.

Even in a case where the slide door 90 is closed through the above-mentioned motor disconnecting operation (i.e. the locking operation of the interior lock operating portion 16), the retention of the slide door 90 in the closed state may be released by performing the unlocking operation of the interior lock operating portion 16 and then, performing the opening operation of the inner door handle 18 or the outer door handle 17, as in the normal case, in order to open the slide door 90.

In this embodiment, the operation of the vehicle door operating mechanism 100K in the case where the interior lock operating portion 16 is operated in order to perform the motor disconnecting operation and in order to open the slide door 90, which is in the closed state, by the motor disconnecting operation is described as an example. However, even in a case where a locking/unlocking operation is performed by the remote control key or in a manner where a key is inserted into a key cylinder provided at the outer surface of the slide door 90, the remote control receiving device 100 may be actuated as in the case where the interior lock operating portion 16 is operated. In other words, the remote control key and the key cylinder are also included in the lock operating portion.

Second Embodiment

A second embodiment of the vehicle door operating mechanism 100K will be described below with reference to FIGS. 18 to 26 of the attached drawings. The vehicle door operating mechanism 100K according to the second embodiment is adapted to the slide door 90 that is modified so as not to include the fully-open door lock mechanism 100. More specifically, the vehicle door operating mechanism 100K according to the second embodiment differs from the vehicle door operating mechanism 100K according to the first embodiment in that the vehicle door operating mechanism 100K according to the second embodiment does not include the fully-open lock lever 170 of the first embodiment, instead, the vehicle door operating mechanism 100K according to the second embodiment includes a relay lever 200, which is formed so as to integrally include the connecting pin penetrating lever 120 and the outer handle connecting lever 150. As illustrated in FIG. 20, the relay lever 200 includes a first lever piece 201 and a second lever piece 202. The arc-shaped elongated hole 153, to which the fourth open cable 94W extending from the outer door handle 17 is connected, is formed at an outer end portion of the first lever piece 201 in the rotating radial direction so as to penetrate therethrough. Furthermore, the L-shaped hole 123 is formed at a portion of the first lever piece 201 located closer to the main support shaft 102 relative to the elongated hole 153. The child lock elongated hole 124 is formed at an outer end portion of the second lever piece 202 in the rotating radial direction so as to penetrate therethrough.

Furthermore, in accordance with the modification and changes of the configuration of the vehicle door operating mechanism 100K according to the first embodiment, the first rod 105, the coil spring 176, the second interlocking contact piece 152 and the interlocking contact piece 164 are also omitted from the vehicle door operating mechanism 100K according to the second embodiment. Other configurations of the vehicle door operating mechanism 100K of the second embodiment are similar to the corresponding configurations of the vehicle door operating mechanism 100K of the first embodiment. Therefore, the same reference numerals are assigned to the identical or similar components between the vehicle door operating mechanism 100K of the first embodiment and the vehicle door operating mechanism 100K of the second embodiment (see FIG. 18). Furthermore, the detailed explanations about the identical or similar components with the first embodiment will be omitted.

An operation of the vehicle door operating mechanism 100K of the second embodiment in a case where an operation of opening the slide door 90, which is retained to be in the closed state, is performed will be described below under an assumption that the child lock is in the unlocked state (i.e. under an assumption that the child lock pin 125 is located at a position indicated by a solid line in FIG. 19).

Figure 19:
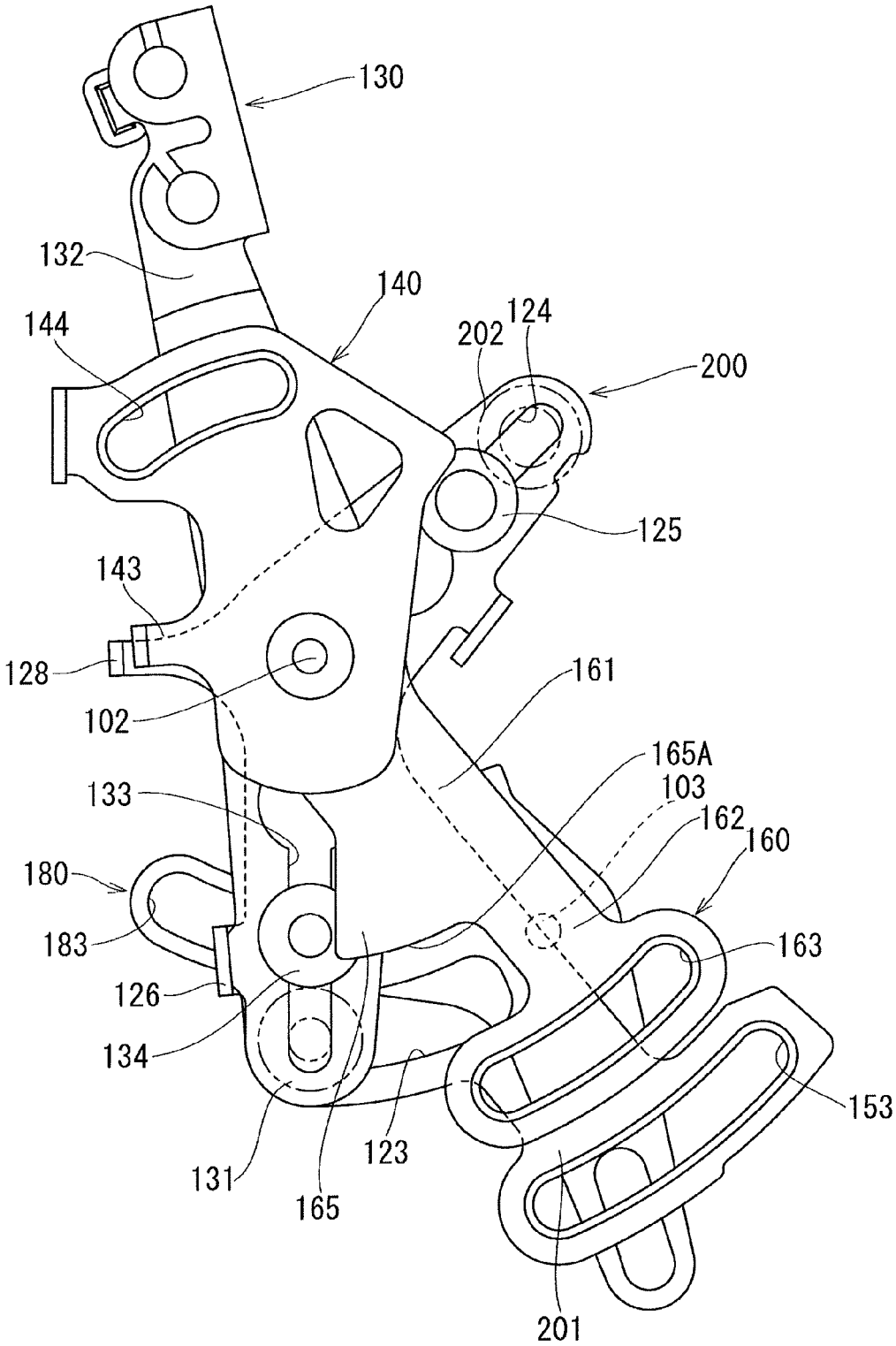
FIG. 19 is a front view of the vehicle door operating mechanism in a normal operation state.
Figure 20:
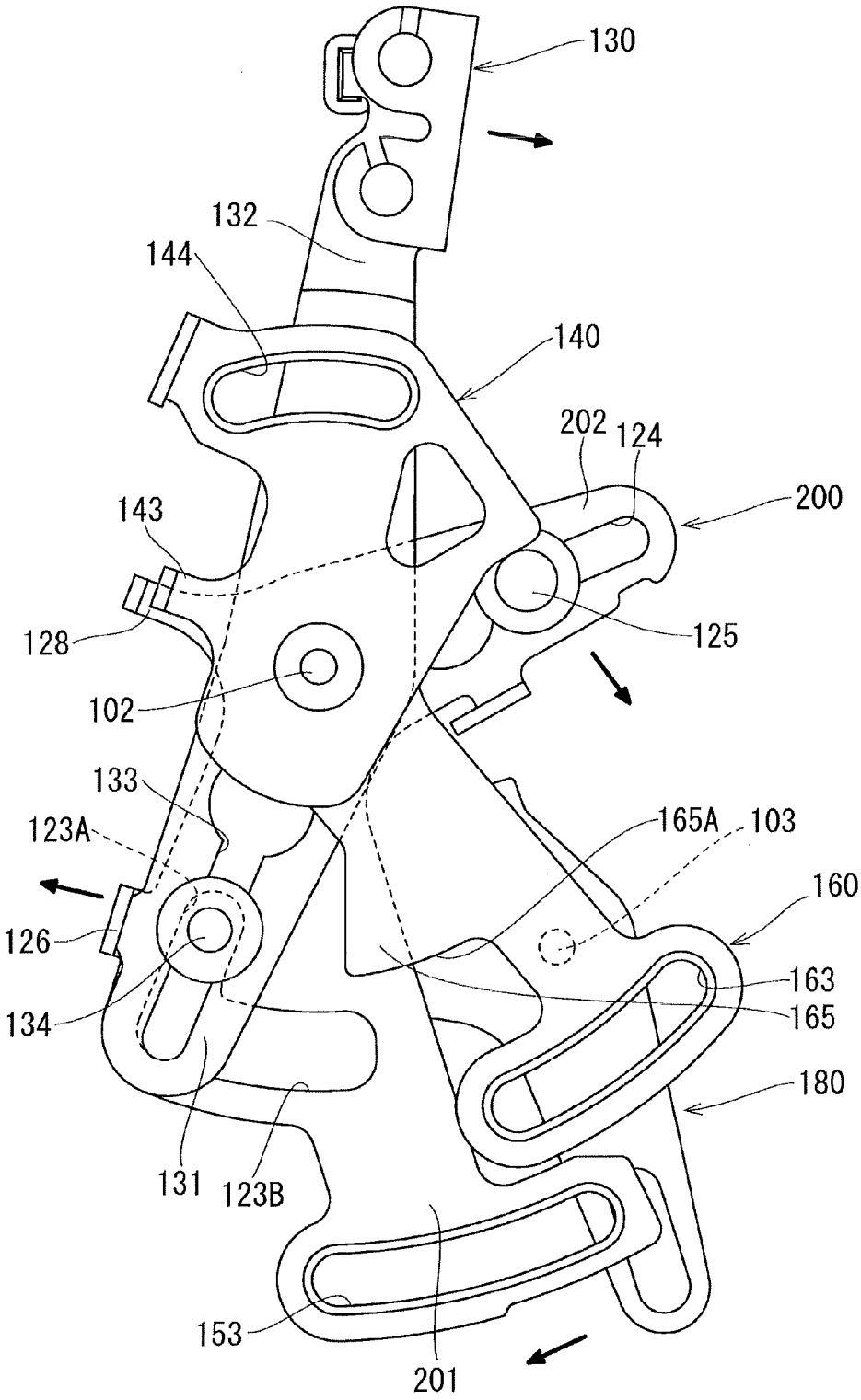
FIG. 20 is a front view of the vehicle door operating mechanism in the case where an inner door handle is operated to open the slide door.

In the case where the inner door handle 18 is operated to open the slide door 90, which is retained to be in the closed state, while the slide door 90 is in the unlocked state (i.e. while the connecting pin 134 is located at the normal unlocking position indicated by a solid line in FIG. 19), the inner handle connecting lever 140 is rotated about the main support shaft 102 in the first rotational direction so as to push the child lock pin 125, thereby rotating the relay lever 200 in the first rotational direction (i.e. the state of the vehicle door operating mechanism 100K is shifted from a state illustrated in FIG. 19 to a state illustrated in FIG. 20). In this case, the ratchet interlocking lever 130 is rotated together with the relay lever 200 as a unit in the first rotational direction, so that the first and second open cables 91W and 92W are pulled towards the remote control receiving device 100. Then, when the ratchet interlocking lever 130 and the relay lever 200 reach the vicinity of respective rotation end positions, which are located away from the corresponding initial positions in the first rotational direction, the latching of the slide door 90 by means of the latch/ratchet mechanisms 20K of the respective front lock mechanism 10A and the rear lock mechanism 10B is released (see FIG. 3). Consequently, the first operation condition of the release motor 60 is satisfied. Accordingly, the motor power transmitting lever 160 is actuated to rotate in the first rotational direction by the motor power generated by the release motor 60, so that a state where the rotation interfering portion 165 contacts the connecting pin 134 (see FIG. 22) is maintained. In other words, the ratchet interlocking lever 130 and the relay lever 200 are retained at the respective rotation end positions, which are located away from the corresponding initial positions in the first rotational direction, by the motor power. As a result, even in the case where the user releases his/her hand from the inner door handle 18 and the inner handle connecting lever 140 is returned to the initial position, the unlatching of the slide door 90 by the latch/ratchet mechanisms 20K may be maintained until the electric door opening/closing mechanism starts being actuated (i.e. until the slide door 90 is started to be electrically slid).

Figure 21:
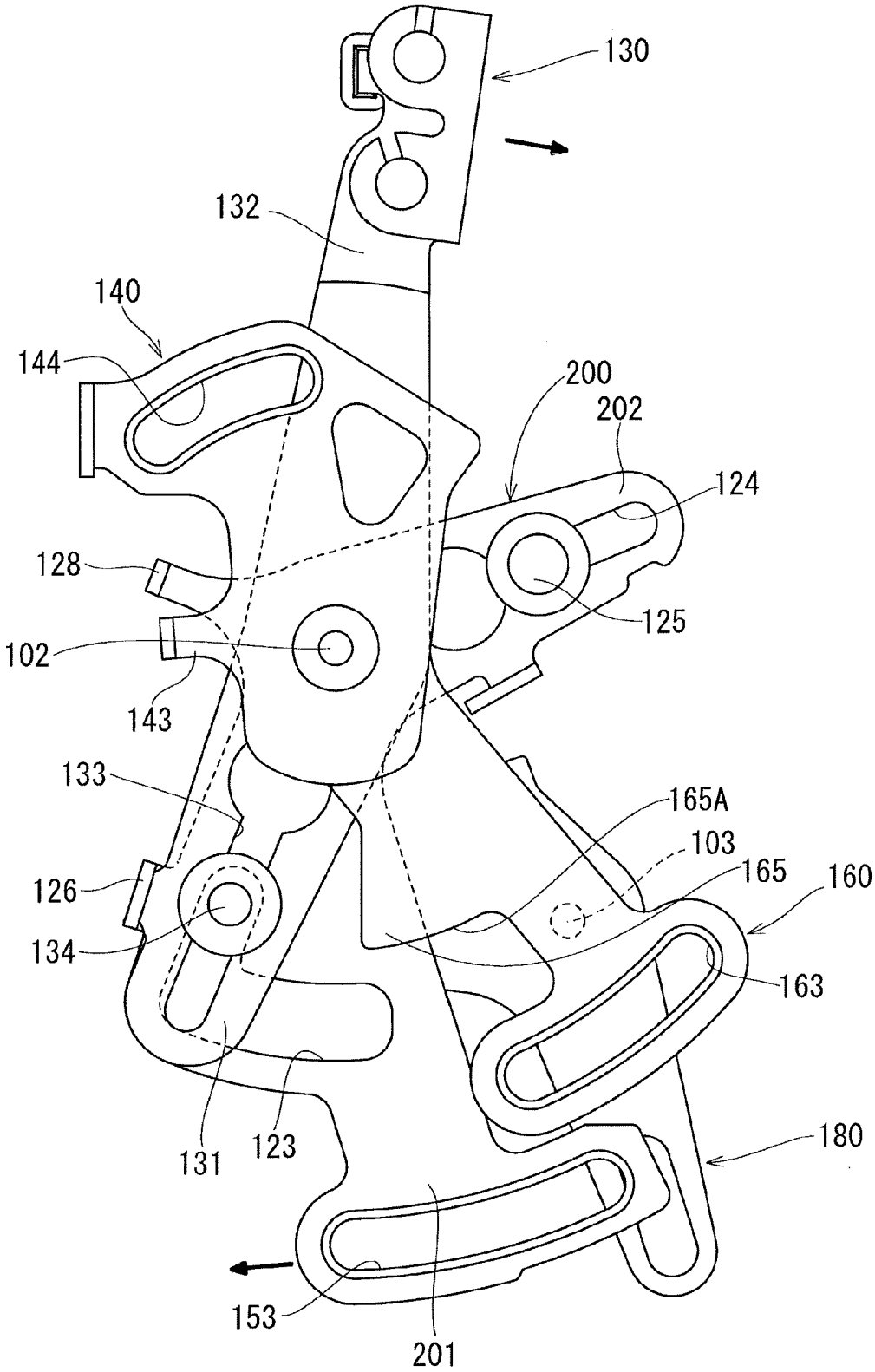
FIG. 21 is a front view of the vehicle door operating mechanism in the case where the outer door handle is operated to open the slide door.

In the case where the outer door handle 17 is operated to open the slide door 90 while the slide door 90 is in the unlocked state, the relay lever 200 is pulled by the fourth open cable 94W so as to be rotated in the first rotational direction together with the ratchet interlocking lever 130 as the unit (i.e. the state of the vehicle door operating mechanism 100K is shifted from the state illustrated in FIG. 19 to a state illustrated in FIG. 21). Then, when the ratchet interlocking lever 130 and the relay lever 200 reach the vicinity of the respective rotation end positions, which are located away from the corresponding initial positions in the first rotational direction, the latching of the slide door 90 by means of the latch/ratchet mechanisms 20K of the respective front lock mechanism 10A and the rear lock mechanism 10B is released (see FIG. 3) and the first operation condition of the release motor 60 is satisfied. Accordingly, the motor power transmitting lever 160 is rotated in the first rotational direction by the motor power of the release motor 60, so that the state where the rotation interfering portion 165 contacts the connecting pin 134 is maintained (see FIG. 22). In other words, the ratchet interlocking lever 130 and the relay lever 200 are retained at the respective rotation end positions, which are located away from the corresponding initial positions in the first rotational direction, by the motor power. As a result, even in the case where the user releases his/her hand from the outer door handle 17, the unlatching of the slide door 90 by means of the latch/ratchet mechanisms 20K may be maintained until the electric door opening/closing mechanism starts being actuated (i.e. until the slide door 90 starts being electrically slid).

In the case where the remote operation is performed without performing the opening operation of the inner door handle 18 or the opening operation of the outer door handle 17 while the slide door 90 is in the unlocked state, the second operation condition of the release motor 60 is satisfied. Then, the motor power transmitting lever 160 is actuated to rotate in the first rotational direction by the motor power of the release motor 60, so that the rotation interfering portion 165 pushes the connecting pin 134 (i.e. the state of the vehicle door operating mechanism 100K is shifted from the state illustrated in FIG. 19 to a state illustrated in FIG. 22). In other words, the motor power transmitting lever 160, the relay lever 200 and the ratchet interlocking lever 130 are integrally rotated as a unit to the respective rotation end positions, which are located away from the corresponding initial positions in the first rotational direction, while receiving the motor power of the release motor 60. Accordingly, the unlatching of the slide door 90 by means of the latch/ratchet mechanisms 20K of the respective front lock mechanism 10A and the rear lock mechanism 10B may be maintained until the electric door opening/closing mechanism starts being actuated (i.e. until the slide door 90 starts being electrically slid).

In the case where the inner door handle 18 is operated to open the slide door 90 while the slide door 90 is in the locked state (i.e. while the connecting pin 134 is located at the locking position indicated by a chain double-dashed line in FIG. 19), the inner handle connecting lever 140 pushes the child lock pin 125, so that the relay lever 200 is accordingly rotated in the first rotational direction. However, in this case, because the connecting pin 134 is allowed to be displaced within the second side passage 123B while the connecting pin 134 is retained at the locking position within the I-shaped elongated hole 133, the power transmission from the relay lever 200 to the ratchet interlocking lever 130 is interrupted. In other words, the ratchet interlocking lever 130 is retained at the initial position indicated in FIG. 19. Accordingly, the retention of the slide door 90 in the closed state by means of the front lock mechanism 10A and the rear lock mechanism 10B is maintained, so that the slide door 90 is not openable.

In the case where the outer door handle 17 is operated to open the slide door 90 while the slide door 90 is in the locked state, although the relay lever 200 is rotated in the first rotational direction, the power transmission from the relay lever 200 to the ratchet interlocking lever 130 is interrupted because the displacement of the connecting pin 134 is limited within the second side passage 123B. In other words, the ratchet interlocking lever 130 is retained at the initial position indicated in FIG. 19. Accordingly, the retention of the slide door 90 in the closed state by means of the front lock mechanism 10A and the rear lock mechanism 10B is maintained, so that the slide door 90 is not openable.

While the slide door 90 is in the locked state, the release motor 60 is not actuated even if the remote operation is performed. Therefore, in this case, the ratchet interlocking lever 130, the motor power transmitting lever 160 and the like are retained at the respective initial positions indicated in FIG. 19, so that the latching of the slide door 90 by means of the front lock mechanism 10A and the rear lock mechanism 10B is maintained.

Additionally, in the case where the inner door handle 18 is operated to open the slide door 90 while the child lock is in the locked state (i.e. while the child lock pin 125 is located at a position indicated by a chain double-dashed line in FIG. 19), although the inner handle connecting lever 140 is rotated in the first rotational direction, the ratchet interlocking lever 130 and the relay lever 200 are retained at the respective initial positions indicated in FIG. 19, because the child lock pin 125 is located at the child lock position and does not contact the inner handle connecting lever 140. Furthermore, because the operation condition of the release motor 60 is not satisfied, the release motor 60 is not actuated. Therefore, the latching of the slide door 90 by means of the front lock mechanism 10A and the rear lock mechanism 10B is maintained without being influenced by the locking/unlocking state of the slide door 90.

Figure 22:
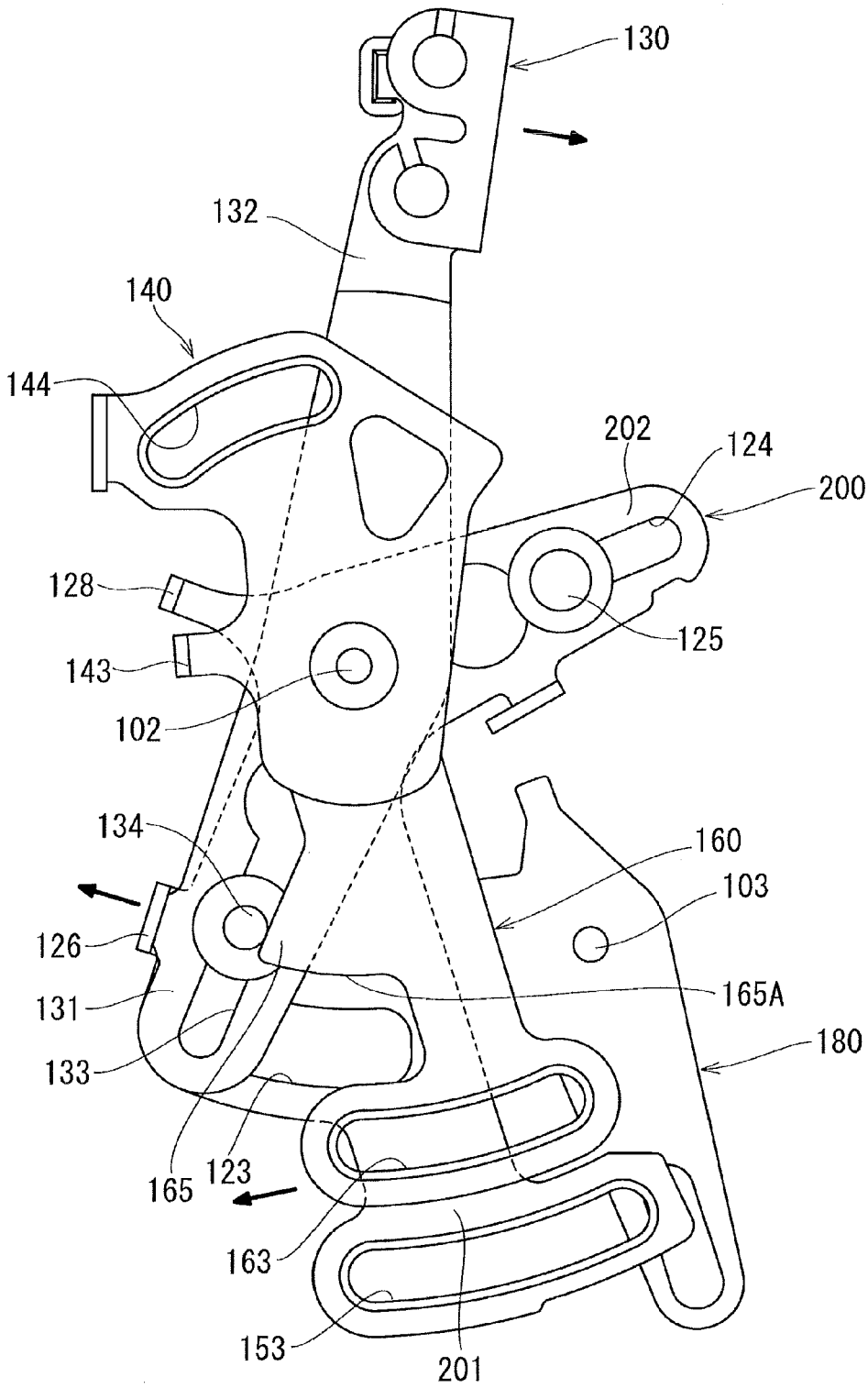
FIG. 22 is a front view of the vehicle door operating mechanism in the case where the release motor is actuated.

As illustrated in FIG. 22, in the case of the emergency where the motor power transmitting lever 160 becomes immovable because of, for example, the malfunction of the release motor 60, the defect on the transmission path of the motor power and the like while the ratchet interlocking lever 130 and the motor power transmitting lever 160 reach the respective rotation end portions, which are located away from the corresponding initial positions in the first rotational direction, and the retention of the slide door 90 in the closed state is released, the locking operation of the interior lock operating portion 16 may be performed in order to displace the connecting pin 134 from the normal unlocking position to the locking position. Accordingly, the connecting pin 134 is displaced to the outside of the rotation range of the rotation interfering portion 165, so that the motor power transmitting lever 160 is disconnected from the ratchet interlocking lever 130 and the relay lever 200 (i.e. the release motor 60 is disconnected from the latch/ratchet mechanisms 20K) and the ratchet interlocking lever 130 and the relay lever 200 are rotated in the second rotational direction by the biasing force of the torsion coil spring 129 (see FIG. 18) so as to return the ratchet interlocking lever 130 and the relay lever 200 to the corresponding initial positions indicated in FIG. 23 (i.e. the state of the vehicle door operating mechanism 100K is shifted from a state illustrated in FIG. 22 to a state illustrated in FIG. 23). As a result, the latch/ratchet mechanisms 20K are returned to the state where the slide door 90 is retainable in the closed state.

Figure 23:
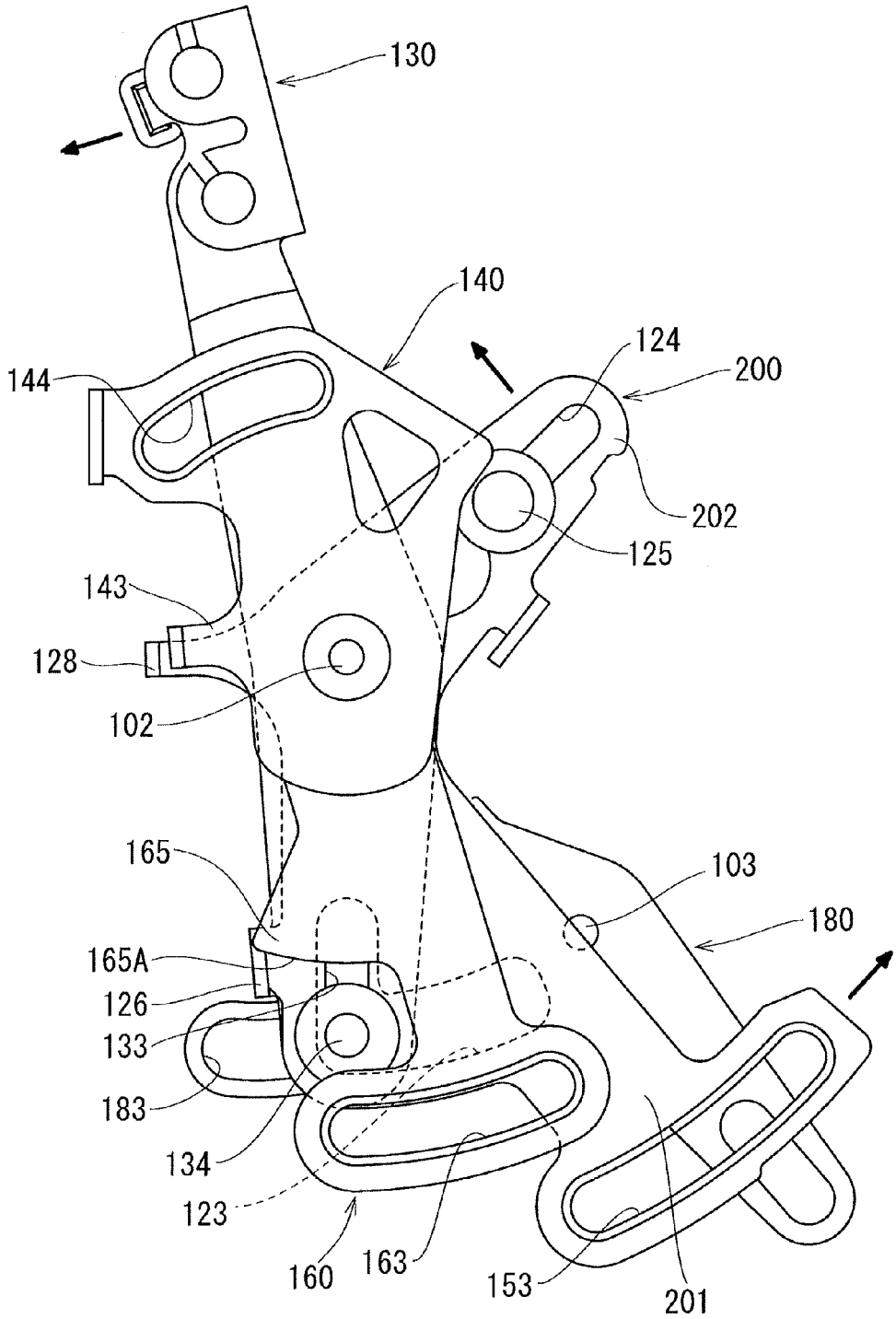
FIG. 23 is a front view of the vehicle door operating mechanism in a case where the motor disconnecting operation is performed in response to the abnormal stoppage of the motor power transmitting lever.

The unlocking operation of the interior lock operating portion 16 may be performed in order to open the slide door 90, which is retained in the closed state, through the motor disconnecting operation. More specifically, as illustrated in FIG. 23, the rotation interfering portion 165 of the motor power transmitting lever 160 overlaps with the inner end portion of the I-shaped elongated hole 133 (i.e. the normal unlocking position) at a point of time where the motor disconnecting operation is performed. Then, in the case where the unlocking operation of the interior lock operating portion 16 is performed while the above-mentioned state is established, the connecting pin 134 is displaced towards the inner end portion of the I-shaped elongated hole 133 from the locking position so as to contact the guide portion 165A of the rotation interfering portion 165, so that the connecting pin 134 is retained at the emergency unlocking position, which is located between the locking position and the normal unlocking position (i.e. at the intermediate portion of the I-shaped elongated hole 133) (i.e. the state of the vehicle door operating mechanism 100K is shifted from the state illustrated in FIG. 23 to a state illustrated in FIG. 24). In the case where the connecting pin 134 is located at the emergency unlocking position, the connecting pin 134 is positioned within the first side passage 123A (i.e. at the unlocking position), so that the power becomes transmittable from the relay lever 200 to the ratchet interlocking lever 130. On the other hand, because the connecting pin 134 is located outside of the rotation range of the rotation interfering portion 165, the motor power transmitting lever 160 is disconnected from the ratchet interlocking lever 130 and the relay lever 200 (i.e. the release motor 60 is disconnected from the latch/ratchet mechanisms 20K).

Figure 24:
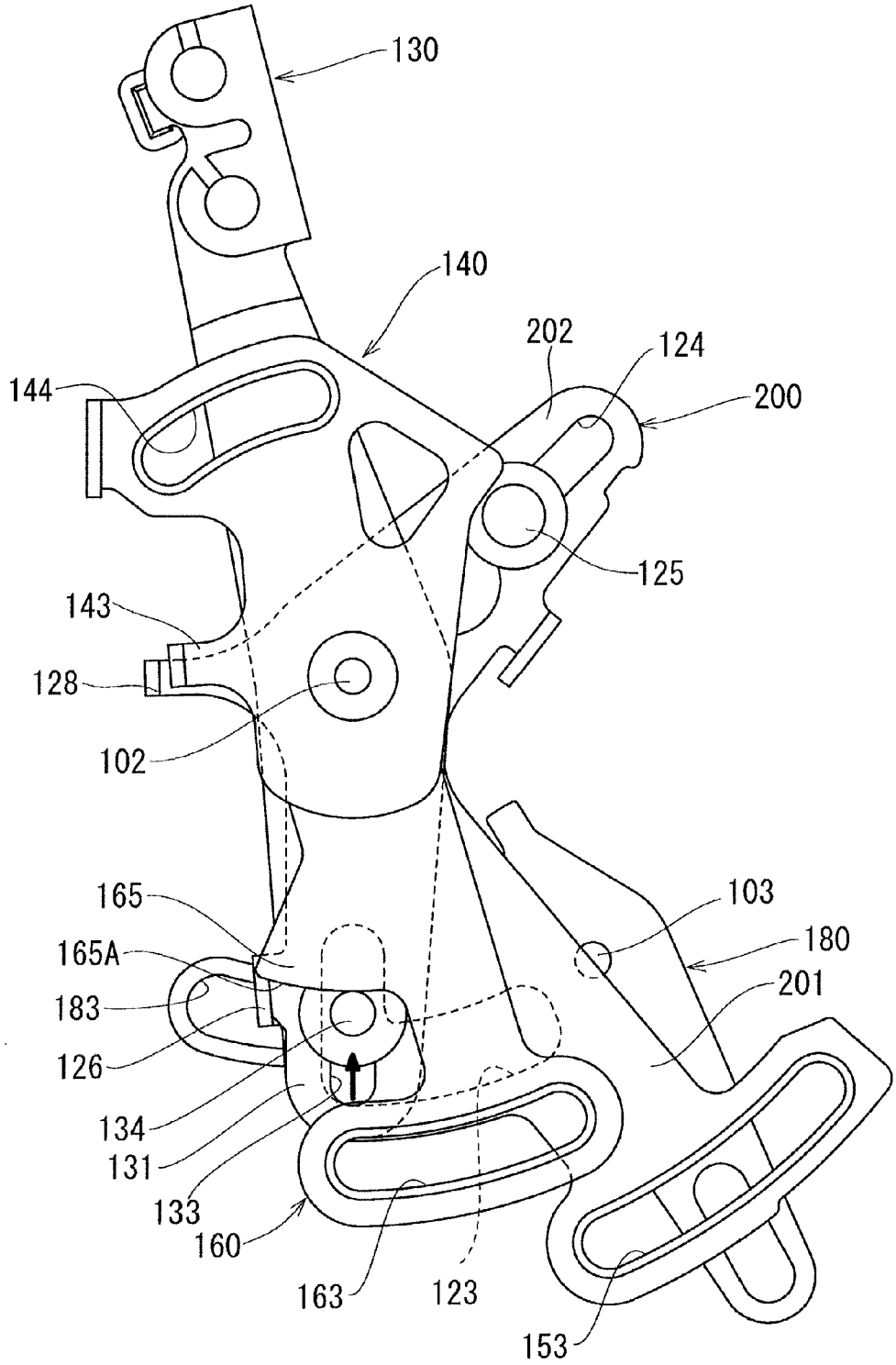
FIG. 24 is a front view of the vehicle door operating mechanism in the case where the connecting pin is positioned at the emergency unlocking position.
Figure 25:
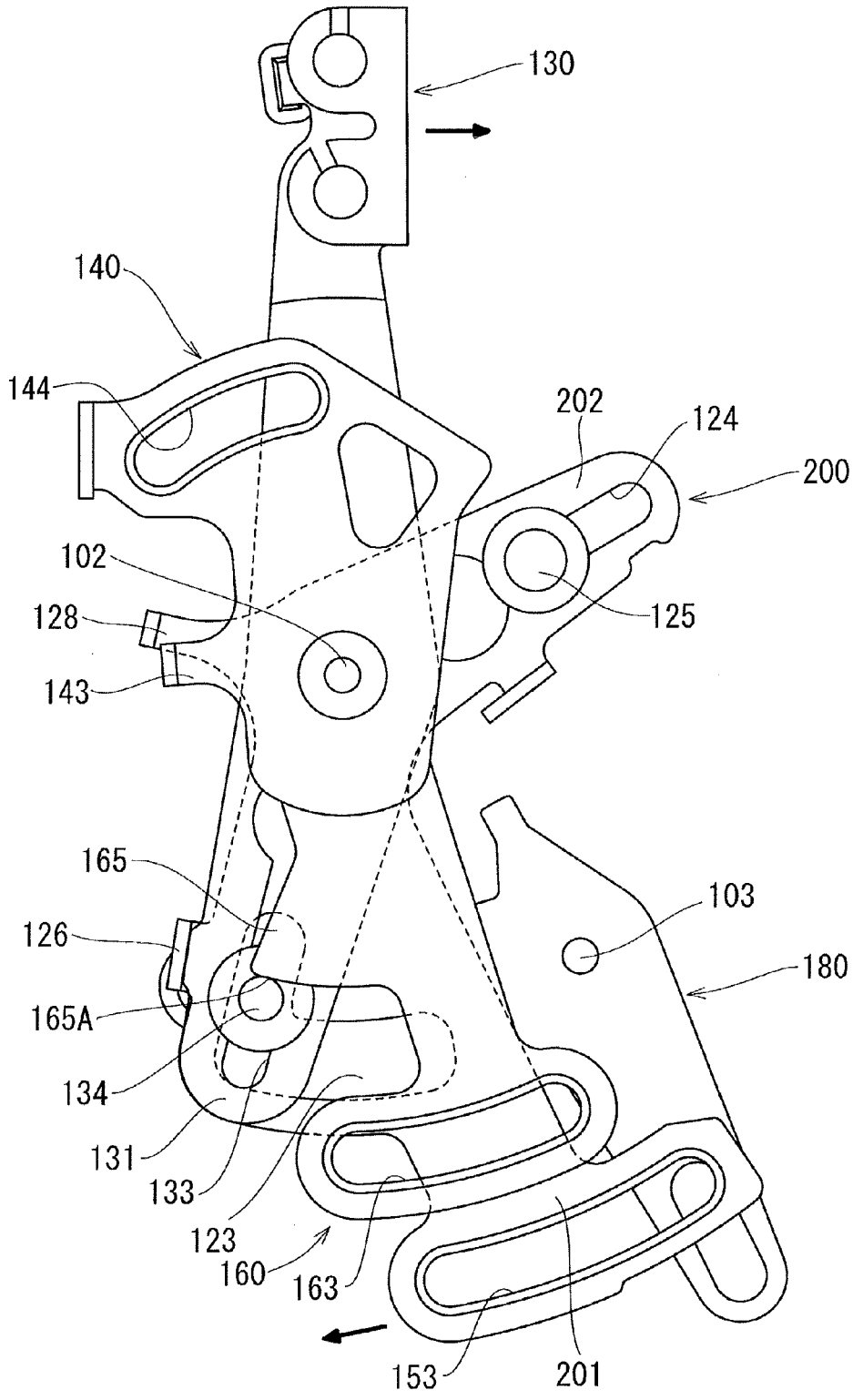
FIG. 25 is a front view of the vehicle door operating mechanism in the case where the connecting pin is positioned at the emergency unlocking position and the outer door handle is operated to open the slide door.
Figure 26:
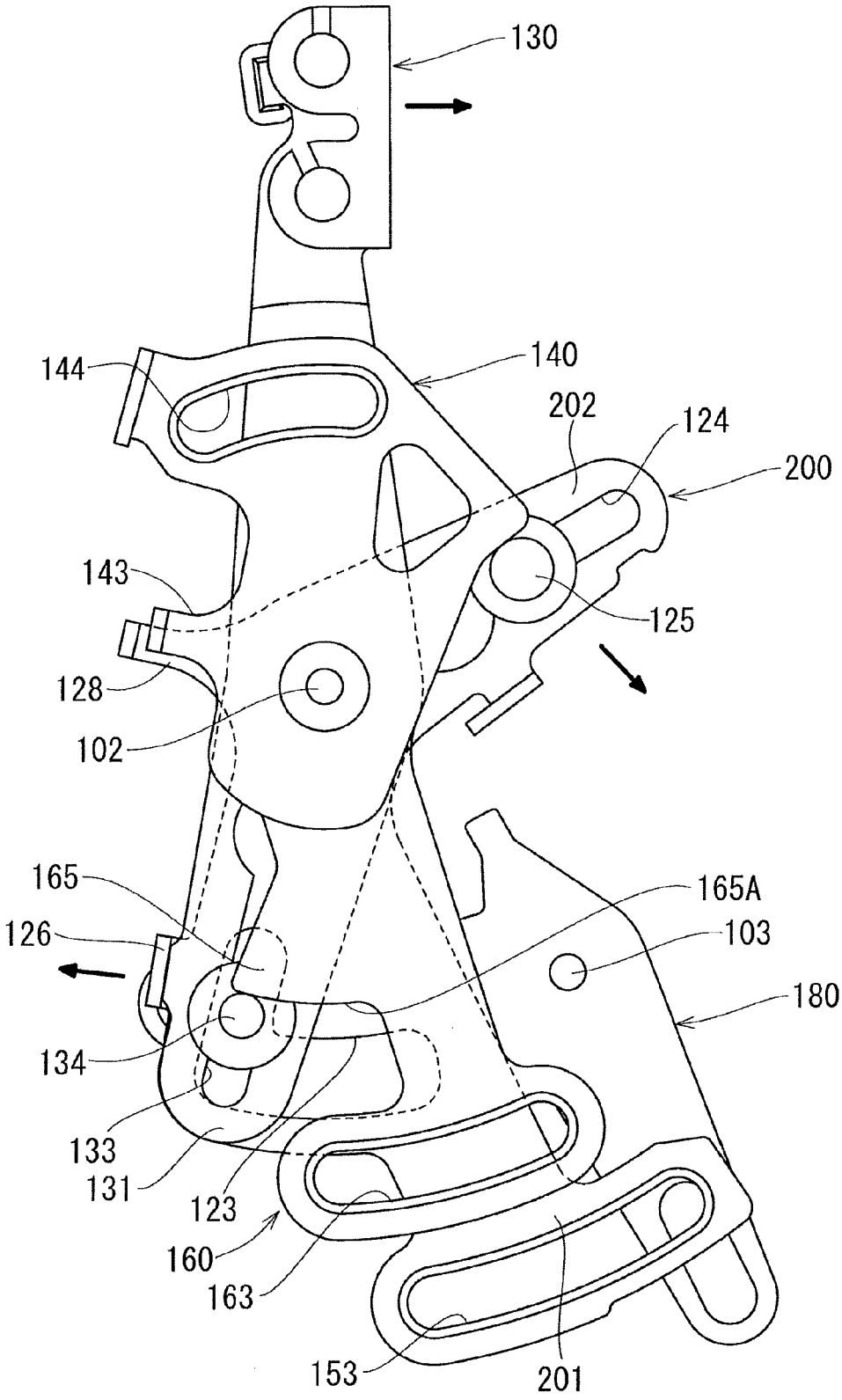
FIG. 26 is a front view of the vehicle door operating mechanism in the case where the connecting pin is positioned at the emergency unlocking position and the inner door handle is operated to open the slide door.

Then, in the case where the outer door handle 17 is operated to open the slide door 90 while the connecting pin 134 is located at the emergency unlocking position, the connecting pin 134 is slid along the guide portion 165A of the rotation interfering portion 165 in the first rotational direction, so that the ratchet interlocking lever 130 and the relay lever 200 are rotated together as the unit in the first rotational direction while the motor power transmitting lever 160 (i.e. the release motor 60), which is abnormally stopped, is disconnected from the ratchet interlocking lever 130 and the relay lever 200 (i.e. the state of the vehicle door operating mechanism 100K is shifted from the state illustrated in FIG. 24 to a state illustrated in FIG. 25). Accordingly, the retention of the slide door 90 in the closed state by means of the front lock mechanism 10A and the rear lock mechanism 10B is released, so that the slide door 90 becomes openable.

Furthermore, in the case where the child lock is in the unlocked state, the slide door 90 may be opened in response to the opening operation of the inner door handle 18. In other words, in the case where the inner door handle 18 is operated to open the slide door 90, the connecting pin 134 is slid along the guide portion 165A of the rotation interfering portion 165 in the first rotational direction, so that the inner handle connecting lever 140, the relay lever 200 and the ratchet interlocking lever 130 are rotated together as the unit in the first rotational direction (i.e. the state of the vehicle door operating mechanism 100K is shifted from the state illustrated in FIG. 24 to a state illustrated in FIG. 26). Accordingly, the retention of the slide door 90 in the closed state by means of the front lock mechanism 10A and the rear lock mechanism 10B is released, so that the slide door 90 becomes openable.

Accordingly, advantages and merits similar to the advantages and merits of the first embodiment may be achieved. Furthermore, because the relay lever 200, which integrally includes the connecting pin penetrating lever 120 and the outer handle connecting lever 150, is adapted to the vehicle door operating mechanism 100K, a number of components used for the vehicle door operating mechanism 100K according to the second embodiment is reduced when comparing to the vehicle door operating mechanism 100K according to the first embodiment.

Other Embodiments

The configuration of the vehicle door operating mechanism 100K is not limited to the above-described configuration examples. For example, the following modified examples and changes are also included in a technical scope of this disclosure. Furthermore, various changes and modifications may be applied to the vehicle door operating mechanism 100K without departing from the spirit of this disclosure.

In the first and second embodiments, the vehicle door operating mechanism 100K includes the child lock switching mechanism (i.e. the child lock pin 125 and the child lock elongated hole 124). However, the vehicle door operating mechanism 100K may be modified so as not to include the child lock switching mechanism. In this case, the inner handle connecting lever 140 may be modified so as to be integrally formed at the connecting pin penetrating lever 120 or the relay lever 200.

In the first and second embodiments, the I-shaped elongated hole 133 is formed at the ratchet interlocking lever 130 and the L-shaped hole 123 is formed at the connecting pin penetrating lever 120 and the relay lever 200. However, the L-shaped hole may be formed at the ratchet interlocking lever 130 and the I-shaped elongated hole may be formed at the connecting pin penetrating lever 120 and the relay lever 200. In a case where the L-shaped hole is formed at the ratchet interlocking lever 130, the second side passage of the L-shaped hole may be formed so as to extend in the first rotational direction from the end portion of the first side passage of the L-shaped hole positioned away from the main support shaft 102.

Figure 27:
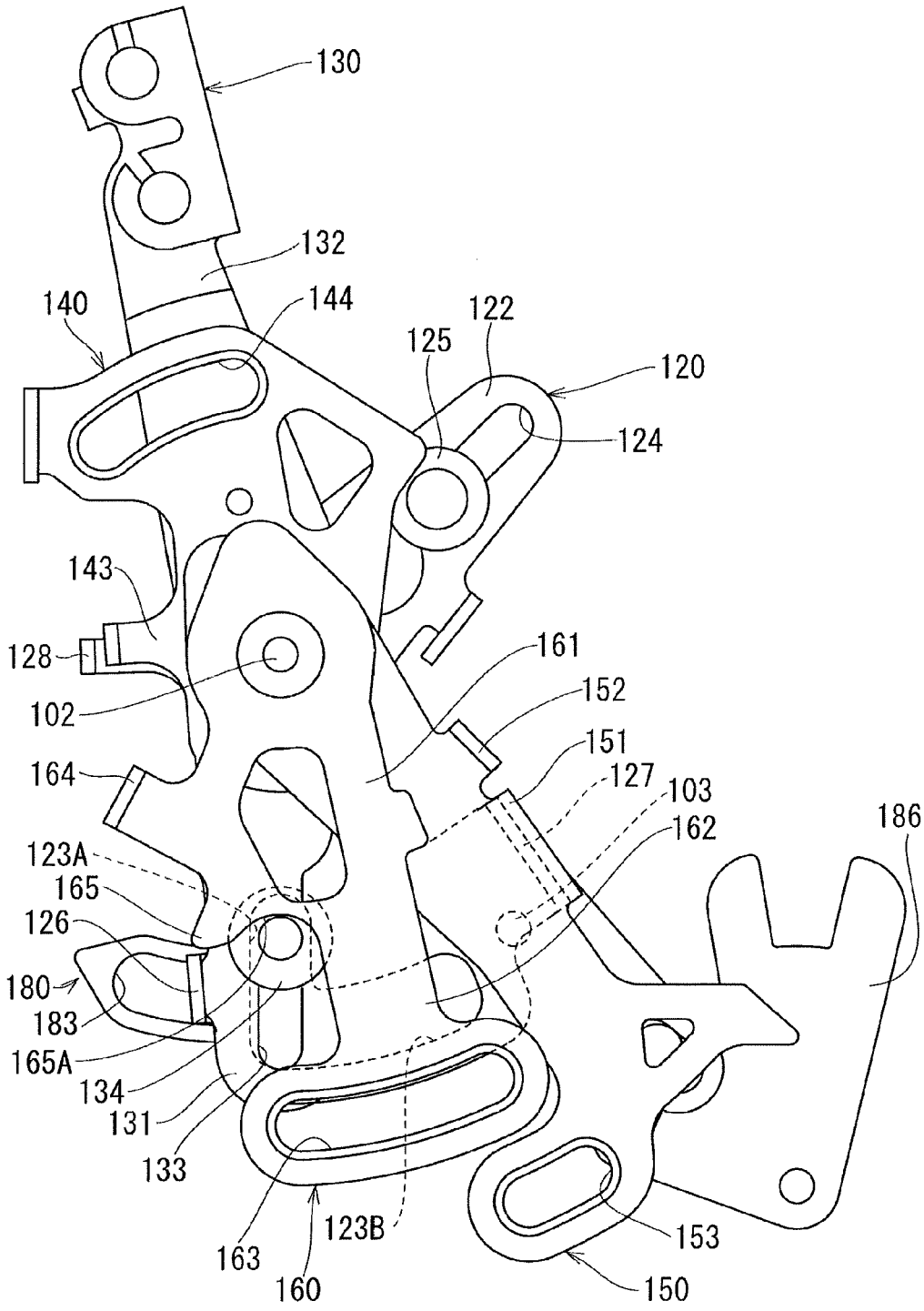
FIG. 27 is a front view of a vehicle door operating mechanism according to a modified example.

In the first and second embodiments, the guide portion 165A of the rotation interfering portion 165 is formed so as to have the arc shape centering on the main support shaft 102. However, as illustrated in FIG. 27, the guide portion 165A may be formed so as to recess (curve) towards the main support shaft 102. In this case, when the motor disconnecting operation is performed to close the slide door 90 and then the unlocking operation of the interior lock operating portion 16 is performed in order to open the slide door 90 in the case where motor power transmitting lever 160 is abnormally stopped at the rotation end portions, which is located away from the initial position in the first rotational direction, the connecting pin 134 contacts a recessed portion of the guide portion 165A. In a case where the outer door handle 17 is operated to open the slide door 90 while the connecting pin 134 contacts the recessed portion of the guide portion 165A, the guide portion 165A guides the connecting pin 134 from inside of the rotation range of the rotation interfering portion 165 to the emergency unlocking position located outside of the rotation range of the rotation interfering portion 165 (i.e. at the intermediate portion of the I-shaped elongated hole 133) in a manner where the connecting pin 134 is slidably guided by the guide portion 165A in a direction opposite to the first rotational direction while contacting the guide portion 165A.

In the above-described embodiments, the vehicle door operating mechanism 100K is adapted to the slide door 90. However, the vehicle door operating mechanism 100K according to the embodiments and modified examples may be adapted to a hinge-type vehicle door.

According to the embodiments, the vehicle door operating mechanism 100K includes the ratchet interlocking lever 130 configured so as to be interlinked with the ratchet 30 of the latch/ratchet mechanism 20K for retaining the slide door 90 of the vehicle 300 in a closed state and so as to be rotated in the first rotational direction from the initial position in the case where the retention of the slide door 90 in the closed state by the latch/ratchet mechanism 20K is released, the handle interlocking lever (120, 140, 150) configured so as to be interlinked with the ratchet interlocking lever 130, rotated in the first rotational direction from the initial position while receiving the operating force generated in response to the opening operation of the operating handle (17, 18), and so as to apply the force in the first rotational direction to the ratchet interlocking lever 130, the motor power transmitting lever 160 configured so as to be interlinked with the ratchet interlocking lever 130, rotated in the first rotational direction from the initial position while receiving the force generated by the release motor 60, and so as to apply the force in the first rotational direction to the ratchet interlocking lever 130, and the connecting pin 134 provided between the ratchet interlocking lever 130 and the handle interlocking lever (120, 140, 150) on the one hand and the motor power transmitting lever 160 on the other hand, and configured so as to be movable between the normal unlocking position, at which the force is transmittable from the handle interlocking lever (120, 140, 150) and the motor power transmitting lever 160 to the ratchet interlocking lever 130 in response to the locking/unlocking operation of the interior lock operating portion 16 that is used for locking and unlocking the slide door 90, and the locking position, at which the force is not transmittable from the handle interlocking lever (120, 140, 150) and the motor power transmitting lever 160 to the ratchet interlocking lever 130, wherein the emergency unlocking position, at which the force is transmittable from the handle interlocking lever (120, 140, 150) to the ratchet interlocking lever 130 and the force is not transmittable from the motor power transmitting lever 160 to the ratchet interlocking lever 130, is set within the moving range of the connecting pin 134, and the motor power transmitting lever 160 includes the guide portion 165A, which is configured so as to retain the connecting pin 134 at the emergency unlocking position, so as to be located to correspond to a portion of the entire rotation range of the motor power transmitting lever 160 in the first rotational direction except for the initial position.

Accordingly, in the case where the interior lock operating portion 16, which is used for locking and unlocking the slide door 90, is operated to displace the connecting pin 134 to the locking position while the slide door 90 is retained to be in the close state, the power transmission from the handle interlocking lever (i.e. the connecting pin penetrating lever 120, the inner handle connecting lever 140 and the outer handle connecting lever 150) and the motor power transmitting lever 160 to the ratchet interlocking lever 130 is interrupted. Accordingly, the slide door 90 is turned to be in the locked state where the slide door 90 is not openable by the operation of the outer door handle 17, the inner door handle 18 and the power generated by the release motor 60. On the other hand, in the case where the connecting pin 134 is displaced towards the normal unlocking position in response to the operation of the interior lock operating portion 16, the force becomes transmittable in the first rotational direction from the handle interlocking lever (i.e. the connecting pin penetrating lever 120, the inner handle connecting lever 140 and the outer handle connecting lever 150) and the motor power transmitting lever 160 to the ratchet interlocking lever 130, so that the slide door 90 is turned to be in the unlocked state where the slide door 90 is openable by the operation of the outer door handle 17, the inner door handle 18 or the power generated by the release motor 60.

In the case where the motor power transmitting lever 160 becomes immovable at a position away from the initial position in the first rotational direction because of the malfunction of the release motor 60, the defect on the transmission path and the like, the connecting pin 134 may be displaced from the normal unlocking position to the locking position in response to the operation of the interior lock operating portion 16. Accordingly, the power transmission from the motor power transmitting lever 160 to the ratchet interlocking lever 130 and the handle interlocking lever (i.e. the connecting pin penetrating lever 120, the inner handle connecting lever 140 and the outer handle connecting lever 150) is interrupted. As a result, the release motor 60 having the defect on the transmission path of the motor power or the release motor 60 having the malfunction is disconnected from the latch/ratchet mechanism 20K. Consequently, the ratchet interlocking lever 130 and the handle interlocking lever (i.e. the connecting pin penetrating lever 120, the inner handle connecting lever 140 and the outer handle connecting lever 150) may be returned to the corresponding initial positions, so that the vehicle door operating mechanism 100K is returned to be in the state where the slide door 90 is retainable in the closed state.

According to the vehicle door operating mechanism 100K of the embodiments, because the interior lock operating portion 16, which is normally used for locking and unlocking the slide door 90, is configured so as to serve also as the operation target of the motor disconnecting operation, the vehicle door operating mechanism 100K may be promptly restored to the state where the vehicle door is retainable in the closed state by the operation of the interior lock operating portion 16 in the process of trial and error without checking the vehicle manual book and the like in the case of the emergency where the slide door 90 becomes not retainable in the closed state because of the malfunction of the release motor 60 and the like. Furthermore, because any specific tool for the motor disconnecting operation is not required, the vehicle door operating mechanism 100K may be promptly restored to the state where the slide door 90 is retainable in the closed state. Still further, in the case where the connecting pin 134 is displaced from the locking position in response to the operation of the interior lock operating portion 16 while the slide door 90 is retained in the closed state by the motor disconnecting operation, as is a case with the outer door handle 17 or the inner door handle 18 being normally operated to open the slide door 90, the connecting pin 134 is displaced to the emergency unlocking position by the guide portion 165A of the motor power transmitting lever 160. In the case where the connecting pin 134 is located at the emergency unlocking position, while the ratchet interlocking lever 130 is interlocked with the connecting pin penetrating lever 120, the inner handle connecting lever 140 and the outer handle connecting lever 150, the ratchet interlocking lever 130 and the handle interlocking lever (i.e. the connecting pin penetrating lever 120, the inner handle connecting lever 140 and the outer handle connecting lever 15) are disconnected from the motor power transmitting lever 160. Therefore, in this case, when the outer door handle 17 or the inner door handle 18 is operated as in the case of the normal opening operation, the force is transmitted from the handle interlocking lever (i.e. the connecting pin penetrating lever 120, the inner handle connecting lever 140 and the outer handle connecting lever 150) to the ratchet interlocking lever 130, so that the retention of the slide door 90 in the closed state is released. As a result, the slide door 90 becomes openable.

According to the embodiments, the vehicle door operating mechanism 100K further includes the main support shaft 102 axially supporting the handle interlocking lever (120, 140, 150), the ratchet interlocking lever 130 and the motor power transmitting lever 160 so as to be rotatable, the rotation interfering portion 165 formed so as to protrude from the motor power transmitting lever 160 in the rotating radial direction of the motor power transmitting lever 160, and the I-shaped elongated hole 133, which extends in the rotating radial direction of the handle interlocking lever (120, 140, 150) or the ratchet interlocking lever 130 and within which the connecting pin 134 is displaced, wherein the normal unlocking position is set at the inner end portion of the I-shaped elongated hole 133, the locking position is set at the outer end portion of the I-shaped elongated hole 133, the emergency unlocking position is set at the intermediate portion of the I-shaped elongated hole 133, and wherein in the case where the connecting pin 134 is located at the emergency unlocking position, the connecting pin 134 is positioned outside of the rotation range of the rotation interfering portion 165.

According to the embodiments, the guide portion 165A is formed at the rotation interfering portion 165 and is configured so as to retain the connecting pin 134 at the emergency unlocking position located outside of the rotation range of the rotation interfering portion 165 in a manner where the guide portion 165A contacts the connecting pin 134 in the rotating radial direction.

According to the embodiments, the guide portion 165A is configured so as to guide the connecting pin 134 to the emergency unlocking position from inside of the rotation range of the rotation interfering portion 165 in the manner where the guide portion 165A slidably contacts the connecting pin 134 from the second rotational direction, which is opposite to the first rotational direction.

Accordingly, the emergency unlocking position is located at the intermediate position between the locking position, which corresponds to the outer end portion of the I-shaped elongated hole 133, and the normal unlocking position, which corresponds to the inner end portion of the I-shaped elongated hole 133. Hence, in the case where the connecting pin 134 is displaced from the locking position towards the normal unlocking position by the operation of the interior lock operating portion 16 while the slide door 90 is retained to be in the closed state by the motor disconnecting operation, the connecting pin 134 is displaced to the emergency unlocking position, which is positioned outside of the rotation range of the rotation interfering portion 165, by the guide portion 165A of the rotation interfering portion 165.

Alternatively, the vehicle door operating mechanism 100K may be modified so that the connecting pin 134 contacts the guide portion 165A in the rotating radial direction, so that the connecting pin 134 is retained at the emergency unlocking position, which is located outside of the rotation range of the rotation interfering portion 165, in the case where the connecting pin 134 is displaced towards the inner end portion of the I-shaped elongated hole 133 from the locking position in response to the operation of the interior lock operating portion 16. Furthermore, the vehicle door operating mechanism 100K may be modified so that the connecting pin 134 is slidably guided by the guide portion 165A of the rotation interfering portion 165 so as to be positioned at the emergency unlocking position located outside of the rotation range of the rotation interfering portion 165, in the case where the connecting pin 134 is displaced towards the inner end portion of the I-shaped elongated hole 133 from the locking position in response to the operation of the interior lock operating portion 16 and then the outer door handle 17 or the inner door handle 18 is operated to open the slide door 90.

According to the embodiments, the inner door handle 18, which serves as the operating handle and is provided at the surface of the slide door 90 facing the interior of the vehicle 300, is connected to the handle interlocking lever (120, 140, 150), and the handle interlocking lever (120, 140, 150) is configured so as to be rotated in the first rotational direction in response to the opening operation of the inner door handle 18.

Accordingly, the slide door 90, which is retained to be in the closed state, may be opened by the motor disconnecting operation and the operation of the inner door handle 18.

According to the embodiments, the L-shaped hole 123 is formed at either one of the handle interlocking lever (120, 140, 150) and the ratchet interlocking lever 130 and includes the first side passage 123A extending in the rotating radial direction and the second side passage 123B extending from the end portion of the first side passage 123A positioned away from the main support shaft 102 and forming the arc shape centering on the main support shaft 102, the I-shaped elongated hole 133 is formed at the other one of the handle interlocking lever (120, 140, 150) and the ratchet interlocking lever 130 and serves as the member linearly moving passage that is overlappable with the first side passage 123A of the L-shaped hole 123 in a case where the handle interlocking lever (120, 140, 150) and the ratchet interlocking lever 130 are located at the respective initial positions, and wherein the force relaying member includes the connecting pin 134 that is configured to penetrate the handle interlocking lever (120, 140, 150) and the ratchet interlocking lever 130 via the I-shaped elongated hole 133 and the L-shaped hole 123 so as to be movable within the I-shaped elongated hole 133 in the longitudinal direction and the L-shaped hole 123 in the longitudinal direction.

Accordingly, the connecting pin 134 serving as the force relaying member penetrates the ratchet interlocking lever 130 and the handle interlocking lever (the connecting pin penetrating lever 120, the inner handle connecting lever 140 or the outer handle connecting lever 150) via the I-shaped elongated hole 133, which is formed at one of the ratchet interlocking lever 130 and the handle interlocking lever, and the L-shaped hole 123, which is formed at the other one of the ratchet interlocking lever 130 and the handle interlocking lever (the connecting pin penetrating lever 120, the inner handle connecting lever 140 or the outer handle connecting lever 150). The I-shaped elongated hole 133 and the first side passage 123A of the L-shaped hole 123 extend in the rotating radial direction. On the other hand, the second side passage 123B of the L-shaped hole 123 is formed so as to have the arc shape centering on the main support shaft 102, which serves as a rotation center of the ratchet interlocking lever 130 and the handle interlocking lever (the connecting pin penetrating lever 120, the inner handle connecting lever 140 or the outer handle connecting lever 150). Therefore, in the case where the connecting pin 134 is located at the force transmitting position, which corresponds to the inner end portion of the I-shaped elongated hole located away from the second side passage 123B, the ratchet interlocking lever 130 and the handle interlocking lever (the connecting pin penetrating lever 120, the inner handle connecting lever 140 or the outer handle connecting lever 150) are rotated together as a unit, so that the force is transmittable from the handle interlocking lever (the connecting pin penetrating lever 120, the inner handle connecting lever 140 or the outer handle connecting lever 150) to the ratchet interlocking lever 130. On the other hand, in the case where the connecting pin 134 is located at the force transmission interrupting position, which corresponds to the outer end portion of the I-shaped elongated hole located closer to the second side passage 123B, the ratchet interlocking lever 130 and the handle interlocking lever (the connecting pin penetrating lever 120, the inner handle connecting lever 140 or the outer handle connecting lever 150) become not rotatable together as the unit, so that the power transmission between the ratchet interlocking lever 130 and the handle interlocking lever (the connecting pin penetrating lever 120, the inner handle connecting lever 140 or the outer handle connecting lever 150) is interrupted. Accordingly, the release motor 60 becomes connectable to and disconnectable from the latch/ratchet mechanisms 20K.

Additionally, in the case where the L-shaped hole 123 is formed at the handle interlocking lever (i.e. the connecting pin penetrating lever 120, the inner handle connecting lever 140 or the outer handle connecting lever 150), the second side passage 123B may be formed so as to extend in the direction opposite to the first rotational direction from the end portion of the first side passage 123A. Furthermore, in the case where the L-shaped hole 123 is formed at the ratchet interlocking lever 130, the second side passage 123B is formed so as to extend in the first rotational direction from the end portion of the first side passage 123A.

According to the embodiments, the outer door handle 17, which serves as the operating handle and is provided at the surface of the slide door 90 facing outside of the vehicle 300, is connected to the handle interlocking lever (120, 140, 150), and the handle interlocking lever (120, 140, 150) is configured so as to be rotated in the first rotational direction in response to the opening operation of the outer door handle 17.

Accordingly, the handle interlocking lever (i.e. the connecting pin penetrating lever 120, the inner handle connecting lever 140 or the outer handle connecting lever 150) may be rotated in the first rotational direction by the opening operation of the outer door handle 17. Furthermore, in the case where the connecting pin 134 is displaced to the emergency unlocking position by the operation of the interior lock operating portion 16, while the slide door 90 is retained to be in the closed state by the motor disconnecting operation, the slide door 90 becomes openable by the outer door handle 17 and the inner door handle 18.

According to the embodiments, the handle interlocking lever is configured so as to include the outer handle connecting lever 150 rotatably supported by the main support shaft 102 and connected to the outer door handle 17 and the connecting pin penetrating lever 120 rotatably supported by the main support shaft 102 and including the I-shaped elongated hole 133 or the L-shaped hole 123, within which the connecting pin 134 is engaged. The outer handle connecting lever 150 and the connecting pin penetrating lever 120 are formed separately from and independently of each other. The connecting pin penetrating lever 120 is pushed by the outer handle connecting lever 150 so as to be rotated in the first rotational direction in the case where the outer door handle 17 is operated to open the slide door 90, and the connecting pin penetrating lever 120 is rotated in the first rotational direction while being disconnected from the outer handle connecting lever 150 in the case where the inner door handle 18 is operated to open the slide door 90.

Accordingly, in the case where the outer door handle 17 is operated to open the slide door 90, the operating force generated in response to the opening operation of the outer door handle 17 is transmitted to the connecting pin penetrating lever 120 from the outer handle connecting lever 150, so that the connecting pin penetrating lever 120 and the outer handle connecting lever 150 are rotated together as the unit in the first rotational direction. On the other hand, in the case where the inner door handle 18 is operated to open the slide door 90, the operating force generated in response to the opening operation of the inner door handle 18 is not transmitted to the outer handle connecting lever 150, so that the outer handle connecting lever 150 is retained at the initial position thereof.

According to the embodiments, the handle interlocking lever is configured so as to include the inner handle connecting lever 140 rotatably supported by the main support shaft 102 and connected to the inner door handle 18 and the connecting pin penetrating lever 120 rotatably supported by the main support shaft 102 and including the I-shaped elongated hole 133 or the L-shaped hole 123, within which the connecting pin 134 is engaged. The inner handle connecting lever 140 and the connecting pin penetrating lever 120 are formed separately from and independently of each other. The vehicle door operating mechanism 100K further includes the child lock switching mechanism (124, 125), which is provided at either one of the inner handle connecting lever 140 and the connecting pin penetrating lever 120 so as to be preciprocable and which is configured so a to be displaceable between the child lock position and the child lock unlocking position in response to the operation of the child lock operating portion 19 provided at the slide door 90. The child lock switching mechanism (124, 125) connects the inner handle connecting lever 140 and the connecting pin penetrating lever 120 so as to be rotated together as the unit while the child lock switching mechanism (124, 125) is located at the child lock unlocking position. The child lock switching mechanism (124, 125) disconnects the inner handle connecting lever 140 from the connecting pin penetrating lever 120 while the child lock switching mechanism (124, 125) is located at the child lock position.

Accordingly, in the case where the child lock switching mechanism (i.e. the child lock elongated hole 124 and the child lock pin 125) is displaced at the child lock unlocking position, the connecting pin penetrating lever 120 and the inner handle connecting lever 140 are connected to each other so as to be rotated together as the unit, so that the latching of the slide door 90 by means of the latch/ratchet mechanisms 20K becomes unlatchable from the inside of the vehicle 300. On the other hand, in the case where the child lock switching mechanism (i.e. the child lock elongated hole 124 and the child lock pin 125) is displaced at the child lock position, the operating force generated in response to the opening operation of the inner door handle 18 is not transmitted to the connecting pin penetrating lever 120, so that the latching of the slide door 90 by means of the latch/ratchet mechanisms 20K is not allowed to be released.

According to the embodiments, the interior lock operating portion 16 is turned to be in the unlocking state, where the slide door 90 is openable in response to the opening operation of the operating handle (17, 18), in the case where the interior lock operating portion 16 is operated in the opening direction of the slide door 90, and in the locked state, where the slide door 90 is not openable in response to the opening operation of the operating handle (17, 18), in the case where the interior lock operating portion 16 is operated in the closing direction of the slide door 90.

According to the embodiments, the second side passage 123B extends from the end portion of the first side passage 123A positioned away from the main support shaft 102 in the second rotational direction opposite to the first rotational direction.

According to the embodiments, the handle interlocking lever includes the outer handle connecting lever 150 rotatably supported by the main support shaft 102 and connected to the outer door handle 17, the inner handle connecting lever 140 rotatably supported by the main support shaft 102 and connected to the inner door handle 18 and the connecting pin penetrating lever 120 rotatably supported by the main support shaft 102 and including the I-shaped elongated hole 133 or the L-shaped hole 123, within which the connecting pin 134 is engaged.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A vehicle door operating mechanism comprising:

a ratchet interlocking lever interlinked with a ratchet of a latch/ratchet mechanism for retaining a vehicle door of a vehicle in a closed state and rotatable in a first rotational direction from an initial position when a retention of the vehicle door in the closed state by the latch/ratchet mechanism is released;

a handle interlocking lever interlinked with the ratchet interlocking lever and configured to rotate in the first rotational direction from an initial position while receiving an operating force generated in response to an opening operation of an operating handle to thereby apply a force in the first rotational direction to the ratchet interlocking lever;

a motor power transmitting lever interlinked with the ratchet interlocking lever and configured to rotate in the first rotational direction from an initial position while receiving a force generated by a release motor to thereby apply the force in the first rotational direction to the ratchet interlocking lever; and a force relaying member provided between a) the ratchet interlocking lever and the handle interlocking lever and b) the motor power transmitting lever and movable between a normal unlocking position, at which the force is transmittable from the handle interlocking lever and the motor power transmitting lever to the ratchet interlocking lever in response to a locking/unlocking operation of a lock operating portion that is used for locking and unlocking the vehicle door, and a locking position, at which the force is not transmittable from the handle interlocking lever and the motor power transmitting lever to the ratchet interlocking lever, wherein a moving range of the force relaying member includes an emergency unlocking position, at which the force is transmittable from the handle interlocking lever to the ratchet interlocking lever and the force is not transmittable from the motor power transmitting lever to the ratchet interlocking lever, the motor power transmitting lever includes a guide portion which is configured to retain the force relaying member at the emergency unlocking position when the motor power transmitting lever is within an entire rotation range of the motor power transmitting lever in the first rotational direction except for the initial position, and the lock operating portion is exposed to the vehicle interior on the surface of the vehicle door facing the vehicle interior.

2. The vehicle door operating mechanism according to claim 1 further comprising a main support shaft rotatably supporting the handle interlocking lever, the ratchet interlocking lever and the motor power transmitting lever, a rotation interfering portion protruding from the motor power transmitting lever in a rotating radial direction of the motor power transmitting lever, and a member linearly moving passage, which extends in a rotating radial direction of the handle interlocking lever or the ratchet interlocking lever and within which the force relaying member is displaced, wherein the normal unlocking position is set at a first end portion of the member linearly moving passage, the locking position is set at a second end portion of the member linearly moving passage, the emergency unlocking position is set at an intermediate portion of the member linearly moving passage, and wherein when the force relaying member is located at the emergency unlocking position, the force relaying member is positioned outside of a rotation range of the rotation interfering portion.

3. The vehicle door operating mechanism according to claim 2, wherein the guide portion is formed at the rotation interfering portion and is configured to retain the force relaying member at the emergency unlocking position located outside of the rotation range of the rotation interfering portion in a manner where the guide portion contacts the force relaying member in the rotating radial direction.

4. The vehicle door operating mechanism according to claim 3, wherein the guide portion is configured to guide the force relaying member to the emergency unlocking position from inside of the rotation range of the rotation interfering portion in the manner where the guide portion slidably contacts the force relaying member from a second rotational direction, which is opposite to the first rotational direction.

5. The vehicle door operating mechanism according to claim 2, wherein an inner door handle, which serves as the operating handle and is provided at a surface of the vehicle door facing an interior of the vehicle, is connected to the handle interlocking lever, and the handle interlocking lever is configured to be rotated in the first rotational direction in response to an opening operation of the inner door handle.

6. The vehicle door operating mechanism according to claim 5, wherein an L-shaped hole is formed at either one of the handle interlocking lever and the ratchet interlocking lever and includes a first side passage extending in the rotating radial direction and a second side passage extending from an end portion of the first side passage positioned away from the main support shaft and forming an arc shape centering on the main support shaft, an I-shaped elongated hole is formed at the other one of the handle interlocking lever and the ratchet interlocking lever and serves as the member linearly moving passage that is overlappable with the first side passage of the L-shaped hole when the handle interlocking lever and the ratchet interlocking lever are located at the respective initial positions, and wherein the force relaying member includes a connecting pin that is configured to penetrate the handle interlocking lever and the ratchet interlocking lever via the I-shaped elongated hole and the L-shaped hole to be movable within the I-shaped elongated hole in a longitudinal direction and the L-shaped hole in a longitudinal direction.

7. The vehicle door operating mechanism according to claim 6, wherein an outer door handle, which serves as the operating handle and is provided at a surface of the vehicle door facing outside of the vehicle, is connected to the handle interlocking lever, and the handle interlocking lever is configured to be rotated in the first rotational direction in response to an opening operation of the outer door handle.

8. The vehicle door operating mechanism according to claim 7, wherein the handle interlocking lever is configured to include an outer handle connecting lever rotatably supported by the main support shaft and connected to the outer door handle and a connecting pin penetrating lever rotatably supported by the main support shaft and including the I-shaped elongated hole or the L-shaped hole, within which the connecting pin is engaged, the outer handle connecting lever and the connecting pin penetrating lever are formed separately from and independently of each other, the connecting pin penetrating lever is pushed by the outer handle connecting lever to be rotated in the first rotational direction when the outer door handle is operated to open the vehicle door, and wherein the connecting pin penetrating lever is rotated in the first rotational direction while being disconnected from the outer handle connecting lever when the inner door handle is operated to open the vehicle door.

9. The vehicle door operating mechanism according to claim 6, wherein the handle interlocking lever includes an inner handle connecting lever rotatably supported by the main support shaft and connected to the inner door handle and a connecting pin penetrating lever rotatably supported by the main support shaft and including the I-shaped elongated hole or the L-shaped hole, within which the connecting pin is engaged, the inner handle connecting lever and the connecting pin penetrating lever are formed separately from and independently of each other, and wherein the vehicle door operating mechanism further includes a child lock switching mechanism, which is provided at either one of the inner handle connecting lever and the connecting pin penetrating lever to be reciprocable and which is displaceable between a child lock position and a child lock unlocking position in response to an operation of a child lock operating portion provided at the vehicle door, the child lock switching mechanism connects the inner handle connecting lever and the connecting pin penetrating lever to be rotatable together as a unit while the child lock switching mechanism is located at the child lock unlocking position, and the child lock switching mechanism disconnects the inner handle connecting lever from the connecting pin penetrating lever while the child lock switching mechanism is located at the child lock position.

10. The vehicle door operating mechanism according to claim 1, wherein the lock operating portion is turned to be in a unlocking state, where the vehicle door is openable in response to the opening operation of the operating handle, when the lock operating portion is operated in an opening direction of the vehicle door, and in a locked state, where the vehicle door is not openable in response to the opening operation of the operating handle, when the lock operating portion is operated in a closing direction of the vehicle door.

11. The vehicle door operating mechanism according to claim 6, wherein the second side passage extends from the end portion of the first side passage positioned away from the main support shaft in the second rotational direction opposite to the first rotational direction.

12. The vehicle door operating mechanism according to claim 6, wherein the handle interlocking lever includes an outer handle connecting lever rotatably supported by the main support shaft and connected to the outer door handle, an inner handle connecting lever rotatably supported by the main support shaft and connected to the inner door handle and a connecting pin penetrating lever rotatably supported by the main support shaft and including the I-shaped elongated hole or the L-shaped hole, within which the connecting pin is engaged.

13. The vehicle door operating mechanism according to claim 1, further comprising:

an inner door handle which serves as the operating handle and is provided at a surface of the vehicle door facing an interior of the vehicle, and wherein the lock operating portion is arranged below the inner door handle.

14. A vehicle door operating mechanism comprising:

a ratchet interlocking lever interlinked with a ratchet of a latch/ratchet mechanism for retaining a vehicle door of a vehicle in a closed state and rotatable in a first rotational direction from an initial position when a retention of the vehicle door in the closed state by the latch/ratchet mechanism is released;

a handle interlocking lever interlinked with the ratchet interlocking lever and configured to rotate in the first rotational direction from an initial position while receiving an operating force generated in response to an opening operation of an operating handle to thereby apply a force in the first rotational direction to the ratchet interlocking lever;

a motor power transmitting lever interlinked with the ratchet interlocking lever and configured to rotate in the first rotational direction from an initial position while receiving a force generated by a release motor to thereby apply the force in the first rotational direction to the ratchet interlocking lever; and a force relaying member provided between a) the ratchet interlocking lever and the handle interlocking lever and b) the motor power transmitting lever and movable between a normal unlocking position, at which the force is transmittable from the handle interlocking lever and the motor power transmitting lever to the ratchet interlocking lever in response to a locking/unlocking operation of a lock operating portion that is used for locking and unlocking the vehicle door, and a locking position, at which the force is not transmittable from the handle interlocking lever and the motor power transmitting lever to the ratchet interlocking lever, wherein a moving range of the force relaying member includes an emergency unlocking position, at which the force is transmittable from the handle interlocking lever to the ratchet interlocking lever and the force is not transmittable from the motor power transmitting lever to the ratchet interlocking lever, the motor power transmitting lever includes a guide portion which is configured to retain the force relaying member at the emergency unlocking position when the motor power transmitting lever is within an entire rotation range of the motor power transmitting lever in the first rotational direction except for the initial position, and the vehicle door operating mechanism further comprises a main support shaft rotatably supporting the handle interlocking lever, the ratchet interlocking lever and the motor power transmitting lever, a rotation interfering portion protruding from the motor power transmitting lever in a rotating radial direction of the motor power transmitting lever, and a member linearly moving passage, which extends in a rotating radial direction of the handle interlocking lever or the ratchet interlocking lever and within which the force relaying member is displaced, wherein the normal unlocking position is set at a first end portion of the member linearly moving passage, the locking position is set at a second end portion of the member linearly moving passage, the emergency unlocking position is set at an intermediate portion of the member linearly moving passage, and wherein when the force relaying member is located at the emergency unlocking position, the force relaying member is positioned outside of a rotation range of the rotation interfering portion.

* * * * *